US005353868A

United States Patent [19]

Abbott

[11] Patent Number: 5,353,868

[45] Date of Patent: Oct. 11, 1994

[54] INTEGRAL TUBE AND STRIP FIN HEAT EXCHANGER CIRCUIT

[76] Inventor: Roy W. Abbott, 450 N. Hubbards Ln., Louisville, Ky. 40207

[21] Appl. No.: 49,823

[22] Filed: Apr. 19, 1993

[51] Int. Cl.[5] ..... F28F 1/32

[52] U.S. Cl. ..... 165/171; 165/147

[58] Field of Search ..... 165/150, 147, 171, 903

[56] References Cited

U.S. PATENT DOCUMENTS

| | | | |
|---|---|---|---|
| 1,970,105 | 8/1934 | Smith | 29/890.07 |
| 2,268,885 | 1/1942 | McCullough | 62/442 |
| 2,271,648 | 2/1942 | Kleist | 165/147 |
| 2,366,224 | 6/1942 | Warp | 454/280 |
| 2,492,909 | 12/1949 | Warp | 428/132 |
| 2,676,001 | 4/1954 | Poland | 165/171 |
| 2,690,002 | 9/1954 | Grewell | 29/890.042 |
| 2,703,702 | 3/1955 | Meinel | 165/128 |
| 2,705,877 | 4/1955 | King | 165/53 |
| 2,722,732 | 11/1955 | Sandberg | 29/890.038 |
| 2,930,208 | 3/1960 | Lyman | 62/428 |
| 2,934,322 | 4/1960 | Hazard | 165/147 |
| 2,983,300 | 5/1959 | Abbott | 29/890.046 |
| 3,178,806 | 4/1965 | Keith | 165/171 |
| 3,224,503 | 12/1965 | Konanz | 165/171 |
| 3,273,637 | 9/1966 | Pauls | 165/171 |
| 3,379,241 | 4/1968 | Gau | 165/53 |
| 3,380,518 | 4/1968 | Canteloube et al. | 165/171 |
| 3,406,750 | 10/1968 | Pauls | 165/171 |
| 3,460,613 | 4/1967 | Kritzer | 165/183 |
| 3,779,311 | 12/1973 | O'Connor et al. | 165/171 |
| 4,071,934 | 2/1978 | Zolman | 165/171 X |
| 4,474,011 | 10/1984 | Nelson et al. | 165/147 X |
| 5,033,544 | 7/1991 | Abbott | 165/184 |
| 5,049,240 | 9/1991 | Hamer et al. | 165/147 X |
| 5,060,722 | 10/1991 | Zdenek et al. | 165/147 X |

FOREIGN PATENT DOCUMENTS

| | | | |
|---|---|---|---|
| 699017 | 12/1964 | Canada | 165/171 |
| 121089 | 12/1966 | Czechoslovakia | 165/171 |
| 1212813 | 3/1960 | France | 165/171 |

OTHER PUBLICATIONS

Bundy, "The New TI", Date Unknown.

*Primary Examiner*—John Rivell
*Assistant Examiner*—L. R. Leo
*Attorney, Agent, or Firm*—Middleton & Reutlinger

[57] ABSTRACT

An apparatus formed by a roll bonding or extrusion process providing continuously tapered or continuously expanding roll bonded refrigerant and air conduits or incrementally sized extrudate refrigerant conduits to optimize internal heat flow throughout the refrigerant circuit. The air conduits are formed integrally with and adjacent to the refrigerant conduits. The air conduits are lanced forming a plurality of fin strips having a plurality of miniature strip fins with slits thereinbetween arranged perpendicular to the direction of air flow. Air circulates through the air conduit and slits, and around the fins and the refrigerant conduit to increase heat transfer between the air and the refrigerant. The apparatus can be utilized to provide a one piece composite refrigeration unit comprising a condenser, an evaporator, an umbilical circuit strip integrally connecting the condenser and the evaporator, wherein the umbilical strip includes a suction tube and a liquid line capillary metering tube.

25 Claims, 14 Drawing Sheets

INTEGRAL TUBE AND STRIP FIN HEAT EXCHANGER CIRCUIT

BACKGROUND OF THE INVENTION

The present invention relates to an improved heat transfer integral tube and strip fin heat exchanger circuit, and to a process for making the integral tube and strip fin heat exchanger circuit, which has particular utility in refrigerant heat transfer.

In refrigeration applications, it is common to utilize a refrigerant-carrying tube to supply the means by which heat is exchanged from the chamber or areas to be conditioned. Ordinarily, the heat removal is accomplished by forced convection between two separated fluids. For example in household refrigerators, air conditioners, or heat pump systems, the two separated fluids would be a refrigerant contained within a tube and air flowing across the refrigerant-carrying tube to assist in transferring heat to or from the tube wall as imparted by the heat of vaporization or condensation of the refrigerant within the tube. In such applications, the refrigerant carrying tubes are usually provided either as a condenser or an evaporator.

In such forced convection applications, it is common practice to provide a balance between the amount of heat transfer surface area and the heat transfer coefficients of the respective surfaces. The air side surface usually has a relatively low heat transfer coefficient; therefore, a greater amount of exposed heat transfer surface is generally provided to maintain this balance. It is also necessary to provide an economic balance between the amount and structure of tile exposed heat transfer surface considering the heat transfer coefficients of the fluids involved. For instance, in a standard refrigeration application, the refrigerant has a significantly greater ability to transfer heat to the tube in which it is carried than does the air which flows thereacross to remove the heat transferred to the tube by the refrigerant. Therefore, it is accepted practice in the refrigeration art to substantially increase the surface area provided on the outside, or air side, of the tube to balance the ability of the refrigerant to supply heat to the inside of the tube. In producing a heat transfer surface it is economically advantageous to attempt to provide the exposed surface area in contact with two fluids in an inverse ratio of the fluids' ability to transfer heat. For this reason, it is accepted practice to add surface area to the air side of the container in the form of fins. Many types of finned tubing are commercially available for use in refrigerant-to air heat exchangers (both evaporators and condensers). One type of extended surface fin known as a "looped fin" as disclosed in my prior U.S. Pat. No. 5,033,544. Another type of extended surface fin known as a "spine fin" is disclosed in my prior U.S. Pat. No. 2,983,300. Plate fins and other types of extended surface fins are disclosed in U.S. Pat. No. 4,143,710 issued to LaPorte et al. These latter fins are complex geometric shapes, which are difficult to fabricate and have a higher degree of wasted material in relation to the heat transfer capacity provided. The spine fin is mechanically weak and has a low resistance to bending and compressive forces; therefore, to permit practical utilization of the spine fin, in use the spine fins are spaced or bunched very closely on the refrigerant tube.

Another disadvantage of the spine fin heat transfer device is that the thin strips of the fin material extend outward radially from the refrigerant tube in a 360 degree radius. The efficiency of the fins in this type of arrangement varies according to the orientation of the fins with respect to the flow of air. Thus, the fins oriented perpendicular to the flow of air have approximately twice the heat transfer capacity of the spines oriented parallel with the flow of air. The air side heat transfer coefficient is enhanced asymptotically with the inverse of fin perimeter, particularly when the fins members are arranged in a position perpendicular to the direction of air flow. This maximizes the flow of heat between fin and air by minimizing the boundary layer of stagnant air at the fin surface.

In simplistic form the equation for transfer of heat is $Q=Ah\Delta T$, where Q is the heat transfer in BTU/hr, A is the surface area, h is the film heat transfer coefficient, and $\Delta T$ is the difference in temperature. The heat transfer coefficient h between the refrigerant and the tube is very high (about 200 to 300 BTU/hr/Degree F.), while the h for air is quite low (from 8 to 30 BTU/hr/Deg F.). From a practical standpoint it is never possible to apply sufficient external surface area to overcome this difference in heat transfer coefficient for the two fluids. However the value of air side heat transfer coefficient can be enhanced significantly by producing the fins in the form of strips with a minimum distance from the leading edge to the leaving leading edge of the strip. Thus, increasing the heat transfer coefficient and reducing fin width minimizes boundary layer depth providing increased heat transfer and also increasing the surface area by the additional edges. The present invention employs a unique fabricating process to improve fin material utilization by arranging all of the fins in an orientation perpendicular to the direction of air flow, and increase the heat transfer coefficient by miniaturizing the fins into strips of minimum depth or width.

Increasing both area ("A") of the heat transfer surface and the heat transfer coefficient ("h") increases the heat transfer capability of the surface significantly. The geometry of the proposed surface positions all of the fins perpendicular to the air stream affording maximum effectiveness for the multi-sheet integral strip fin and refrigerant tube heat exchanger circuit. The integral design maximizes heat flow between the fin and tube and also provides fin rigidity which minimizes handling damage in manufacture and cleaning damage in product use.

For improved performance, an optimization should be achieved between fluid velocity and pressure drop to maximize heat transfer from the refrigerant to the inner wall of the tube or flow conduit. High fluid velocity promotes high heat transfer coefficient but results in high resistance to flow or pressure drop. Since a distinct relationship exists between pressure and temperature (saturation), a high pressure difference as the fluid progresses through the conduit results in a corresponding great temperature difference between the inlet and the outlet which reduces the drive of heat flow to the inner wall of the conduit. In present practice a compromise between the advantage of high velocity and the disadvantage of the resulting pressure drop and temperature change has been accomplished by paralleling or branching the fluid circuits at predetermined points along the circuit. This practice provides marginal optimization of internal heat flow at some predetermined flow rate but leaves much to be desired as rate of flow varies as in heat pump applications. However, an embodiment of the present invention is designed to utilize tapered refrigerant tubes formed integrally within the fins as a novel means to maintain the advantage of high velocity and reduce pressure drop and temperature change within the refrigerant system.

SUMMARY OF THE INVENTION

Accordingly, an object of the present invention is to provide an integral strip fin and refrigerant tube heat exchanger circuit for optimum heat transfer.

It is another object of the present invention to provide a roll bonding and extrusion method to manufacture the integral tube and strip fin heat exchanger circuit.

It is another object of the present invention to provide an integral tube and strip fin heat exchanger circuit having a strip fin of increased heat transfer capacity which will permit the same amount of heat transfer to be accomplished with a significantly reduced amount of heat transfer materials.

It is another object of the present invention to provide a miniature strip fin for maximizing air side heat transfer coefficient.

It is another object of the present invention to provide an extruded integral tube and strip fin heat exchanger circuit having an increased fin to tube ratio by extruding a plurality of air conduits between adjacent refrigerant tubes, lancing the air conduits forming fin strips, and matching refrigerant coil depth to performance requirements by forming a selected number of strips between tubes and/or extruding a multiply layers of refrigerant conducts and air conduits.

It is yet another object of a preferred embodiment of the present invention to provide an increased fin to tube surface area ratio by the lamination of roll bonded sheets and lancing a plurality of fin strips between adjacent tubes integrally formed therein matching coil depth to performance requirements.

It is an object of the present invention to provide a tube and strip fin heat exchanger circuit having all strip fins oriented perpendicular to the direction of air flow.

It is an object of the present invention to provide a tube and strip fin heat exchanger circuit having excellent water drainage characteristics.

It is a further object of the present invention to provide a roll bonded integral tube and strip fin heat exchanger having an infinitely tapered refrigerant conduit to eliminate the need for parallel circuits and for maximizing internal heat transfer by optimizing refrigerant velocity while minimizing refrigerant pressure drop.

It is a further object of the present invention to provide an extruded integral tube and strip fin heat exchanger having incrementally variable sized refrigerant conduits connected together with tapered return bends to eliminate the need for parallel circuits and for maximizing internal heat transfer by optimizing refrigerant velocity while minimizing refrigerant pressure drop.

It is a further object of the present invention to provide a refrigerant conduit or coil with structural strength to support upper components.

Yet another object of the present invention is to provide a refrigerant coil with structural integrity and appearance to eliminate the need for an outer protective and structurally supportive grill.

It is an object of the present invention to increase the fin to tube surface area ratio by extruding a plurality of fin strips between adjacent tubes.

It is an object of the present invention to maintain continuity at the lanced strip fin ends for improved handling.

Finally, it is another object of the present invention to provide a means of varying the strip fin width by adjusting the material feed in the fin manufacturing process.

Other objects and further scope of the present invention will become apparent from the detailed description provided below. It should be understood; however, that the detailed description provided herein is illustrative only, given for the purposes of indicating how to make and use the presently preferred embodiments of the present invention, and that various modifications will be apparent to those skilled in the art which will not depart from the objects and scope of the present invention.

To achieve the above objects of the present invention, low cost sheets of heat transfer material, preferably aluminum, are used to provide both the refrigerant circuit and the air side extended strip fin. The refrigerant to air circuit of integral tube and strip fin construction of the present invention eliminates the need for tubing as a secondary material while completely eliminating any resistance to heat flow between the strip fin and fluid circuit. The integral design provides a means to contain the refrigerant at its operating pressure with a wall thickness compatible with normal strip fin thickness.

The present claimed invention uses either a roll bonding or extrusion process to achieve the best of both air side and refrigerant side performance by providing integral tube and strip fin material, miniature strip fins arranged perpendicular to the direction of air flow, and the ability to use a continuously tapered or continuously expanding roll bonded refrigerant conduit or a incrementally tapered extrudate refrigerant conduit to optimize internal heat flow throughout the refrigerant circuit.

Roll bonding and extrusion of aluminum is a known art and has long been utilized in the construction of refrigeration components. The roll bond process has also been used to construct refrigerant circuits but has not been economically competitive in forced draft applications due to the manufacturer's inability to produce a circuit having a thin fin thickness (at least two times circuit wall thickness) resulting in poor material utilization.

In the roll bond embodiment of the invention, a sheet of aluminum is printed with a "no weld" ink outlining the desired shape for the refrigerant and strip fin heat exchanger circuits where welding is not desired. A companion sheet of the same size and thickness is placed onto the printed sheet at an elevated temperature of approximately 600° F., and the two sheets are run through a rolling mill which reduces the overall thickness by approximately 60%. The roll bonding process bonds the uninked areas together by welding all of the non-coated areas. The assembly is then placed between platens and the unwelded areas are expanded to a predetermined amount forming integral refrigerant conduits and air conduits which are lanced forming strip fins therein.

Thus, the present invention teaches a method of forming a roll bonded integral tube and strip fin heat exchanger circuit comprising the steps of roll bonding at least two thermally conductive sheets of material and bonding the thermally conductive sheets in selected areas forming a multi-sheet roll bonded laminate. The roll bonded laminate is placed between platens and expanded between the integral multi-sheet roll bonded laminate with a pressurized gas forming a plurality of conduits between the selected areas. The alternate conduits are lanced forming at least one fin strip in each of the thermally conductive sheets. Each fin strip is formed having a plurality of strip fins therein.

One preferred embodiment of the roll bonded integral tube and strip fin heat exchanger circuit comprises a first thermally conductive sheet of material roll bonded at preselected points to a second sheet of thermally conductive material, bonding the first sheet and the second sheet together at preselected points, thereby forming an integral roll bonded laminate having a refrigerant conduit defining a generally serpentine pattern. The integral roll bonded laminate is expanded forming a refrigerant conduit and at least one air circuit thereinbetween. The air conduit is formed integrally with and adjacent to the refrigerant conduit. The air conduit is lanced forming a pair of fin strips having a plurality of strip fins with slits thereinbetween. Air circulates through the air conduit and slits, and around the fins and the refrigerant conduit to increase heat transfer between the air and the refrigerant conduit.

An alternate roll bonded integral tube and strip fin heat exchanger circuit embodiment includes a third sheet and a fourth sheet of thermally conductive material roll bonded together with the first and said second sheet at preselected points forming an integral quadruple sheet roll bonded laminate defining a generally serpentine pattern. The integral roll bonded laminate is expanded forming a refrigerant conduit and at least three air conduits thereinbetween. The air conduits are formed integrally with and adjacent to the refrigerant conduit, and the air conduits are lanced forming four fin strips having a plurality of strip fins with slits thereinbetween.

A multi-sheet roll bonded integral refrigerant tube and strip fin heat exchanger circuit can be utilized to provide a one piece composite refrigeration unit comprising a condenser, an evaporator, an umbilical circuit strip integrally connecting the condenser and the evaporator, wherein the umbilical strip includes a suction tube and a liquid line metering tube.

In the extrusion embodiment of the present invention, an extruded integral tube and strip fin heat exchanger circuit comprises an extrudate having at least one refrigerant conduit and at least one air conduit sharing at least one common interior sidewall. The air conduit is lanced forming at least two fin strips having a plurality of strip fins with slits thereinbetween, whereby air circulates through said air conduit and said slits, and around said fins and said refrigerant conduit to increase heat transfer between said air and said refrigerant conduit. Thus, an extrusion process is used to extrude an integral tube and strip fin heat exchanger circuit in a fashion having multiple layers of alternating refrigerant tubes and air conduits having integrally connecting sidewalls. Individual refrigerant tubes and air conduits can vary in cross-sectional area and be of any desired length. Joining of the refrigerant tubes comprising the refrigerant circuit is accomplished by joining curved end tubes, "return bends", to the refrigerant tubes integrally formed within the circuit. Furthermore, the extruded integral tube and strip fin heat exchanger circuit may comprise incrementally variable sized refrigerant conduits joined together by return bends tapered according to the size of said refrigerant conduits.

A punch and die assembly is utilized to punch or "lance" the integrally formed air conduits between the refrigerant conduits of the integral roll bonded tube and strip fin heat exchanger circuits and the refrigerant conduits of the integral extruded tube and strip fin heat exchanger circuit creating a plurality of thin fin strips for air circulation between the refrigerant conduits. A plurality of punches can be aligned in cooperative relationship with primary dies stacked vertically to lance strip fins in the integrally formed air conduits of several layers of the extruded circuit in a continuous process; however, the air conduits integrally formed in the roll bond refrigerant heat exchanger circuit must be lanced in at least two separate punch and die assemblies depending upon the orientation and pattern of the refrigerant circuit because of the integrally formed return bends formed in the roll bonding process.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
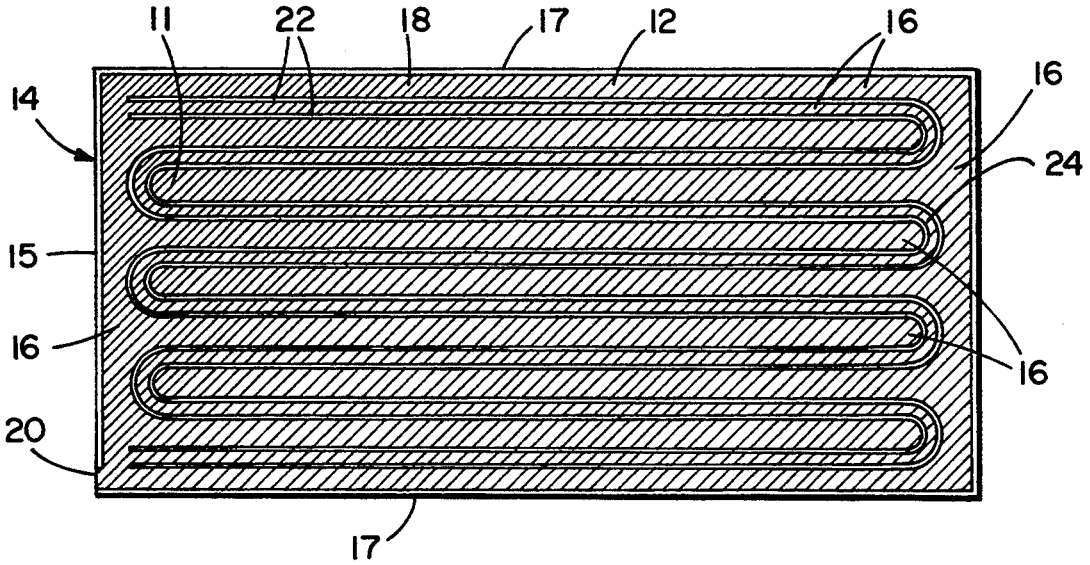
FIG. 1 is a top view of one of the inked sheet showing the dark shaded no-weld inked surfaces and the light to-be-welded surface areas of the roll bonded embodiment of the present invention.

In reference to FIG. 1, a roll bonded embodiment of the integral tube and strip fin heat exchanger circuit of the present invention is fabricated in a roll bonding process combining several work stations. In the roll bond process, the roll bond integrated tube and strip fin heat exchanger circuit is made from thermally conductive sheets of material, preferably metal such as copper, aluminum, brass, tin, iron, lead, and/or combinations and/or alloys thereof. As shown in the preferred embodiment of the present invention, "no-weld" ink 12 is applied to selected portions of a first blank sheet of thermally conductive aluminum stock 14 having a first sheet top surface 11, a first sheet bottom surface 13 (shown in FIG. 4), a first end 15, opposing sides 17, and a second end 19. The first sheet 14 has a thickness of about 60/1,000 to about 65/1,000 of an inch. Thinner sheets could be used in the roll bonding process; however, the thickness of the sheets were selected in accordance with producing a finished product having a wall thickness in the range of about 0.020 to about 0.030 of an inch thick to containing from about 300 to about 700 pounds per square inch of refrigerant pressure, in order to meet present Underwriter Laboratories standards.

In the preferred roll bond embodiment, the no-weld ink 12 is applied to the no-weld areas 16 of the first sheet top surface 11 of the first thermally conductive sheet 14 to form a parameter inked weld-line 18 drawn around the edge of the no-weld area 16 of the first sheet 14 leaving a small connector opening 20 at one corner. Application of the no-weld ink 12 to selected interior portions of the first sheet 14 forms a pair of non-inked interior weld lines 22 drawn spaced apart equal distance from one another to create a serpentine shaped refrigerant circuit pattern 24 outlined on the top surface 11 of the first sheet 14. Although FIG. 1 illustrates the preferred roll bond embodiment having generally parallel spaced apart lines forming the inked serpentine shaped refrigerant circuit pattern 24, it is contemplated that any continuous pattern could be inked providing tapered portions or enlarged portions for a particular application.

Figure 19:
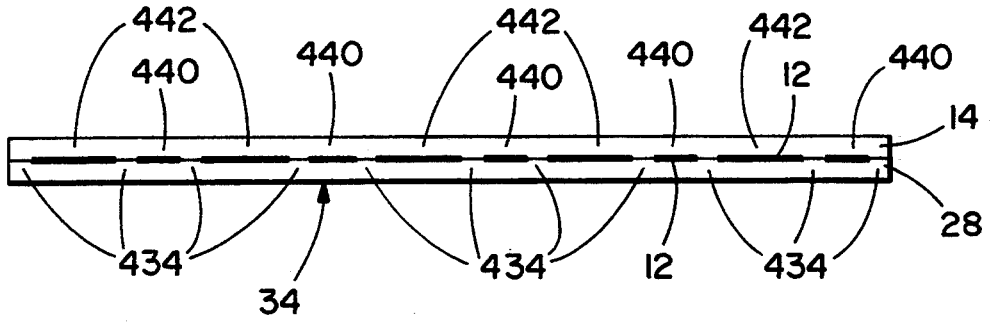
FIG. 19 is an end view of the inked sheets aligned and placed together forming a double layer sheet sandwich in preparation for the roll bonding process.

A second thermally conductive companion blank sheet 28 (shown in FIG. 4) of the same size and thickness as the first sheet 14, having a second sheet top surface 11, a second sheet bottom surface 13, a first end 15, opposing sides 17, a second end 19, and a thickness of about 60/1,000 to about 65/1,000 of an inch is aligned and placed in contact with the inked surface 11 of sheet 14. As shown in FIG. 19, the inked no-weld surface areas 16 of inked sheet 14 placed together with uninked sheet 28 forms a multi-sheet, or more specifically, a double sheet layer 32. Non-inked lines 22 weld at areas 434; however, no-weld ink 12 separates sheets 14 and 28 in the no-weld areas 440 and 442 which are expanded to form refrigerant conduits 40 and air conduits 42, respectively.

The inked double sheet layer 32 is heated to approximately 600° F., and moved through a rolling mill under high pressure such as described in U.S. Pat. No. 2,690,002 by Grenell, hereby incorporated by reference. The high pressure roll bonding process reduces the thickness of the inked double sheet layer 32 by approximately 60% so that each sheet 14 and 28 is about 0.025 of an inch thick. The roll bonding process hermetically bonds the non-ink-coated weld line surface areas 22 of the double sheet layer 32 together forming a welded integral multi-sheet, more specifically, a double sheet roll bonded laminate 38 having interior weld joints 34, end perimeter weld joints 35, and side perimeter weld joints 36 as illustrated in FIG. 2, 3, and 4.

Figure 2:
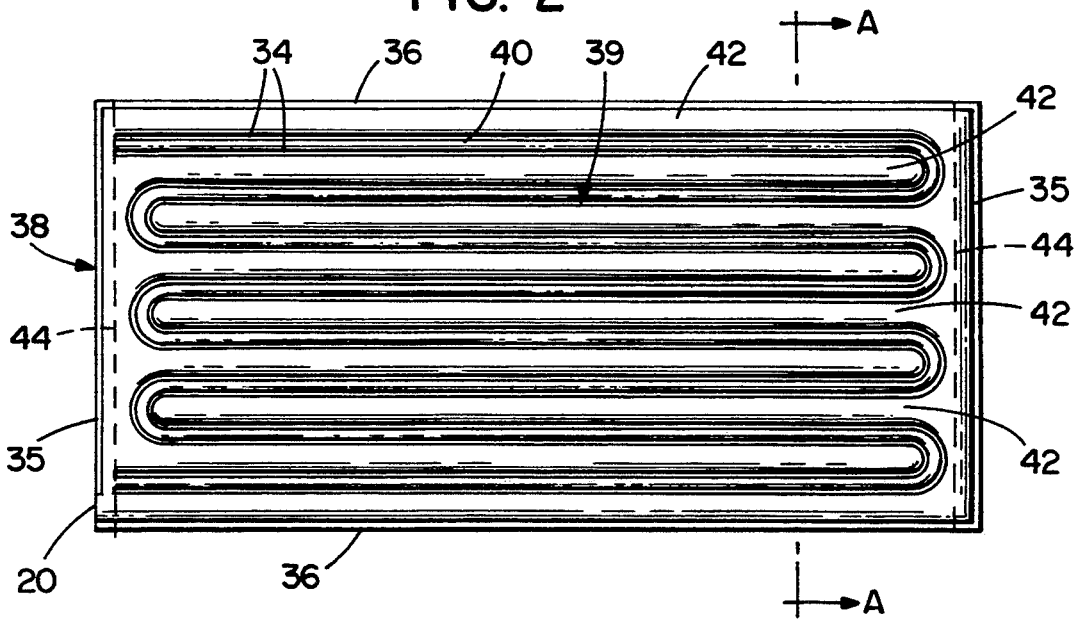
FIG. 2 is a top view of a double sheet roll bonded laminate, showing the refrigerant and air conduits between the welds of the roll bond embodiment of the present invention.

The welded double sheet roll bonded laminate 38 as shown in FIG. 2 is then placed between a pair of platens and connected to a pressurized gas supply means via the connector opening 20. The inked unwelded surface areas 16 are expanded (inflated between platens) with a high pressure gas such as nitrogen or air to a predetermined amount forming conduits between the welds 34–36, more particularly, a continuous refrigerant conduit 40 between the interior welds 34, and air conduits 42 between the interior welds 34 of the refrigerant conduit 40 and the perimeter end welds 35 and perimeter side welds 36. Moreover, the continuous refrigerant conduit 40 forms a roll bonded refrigerant circuit 39. The end perimeter weld joints 35 are positioned normal to the curved portions of the roll bonded refrigerant pattern 24 and trimmed according to perforation lines 44 as shown in FIG. 2, providing access to the air conduits 42 for the lancing and strip fin forming process.

Figure 3:
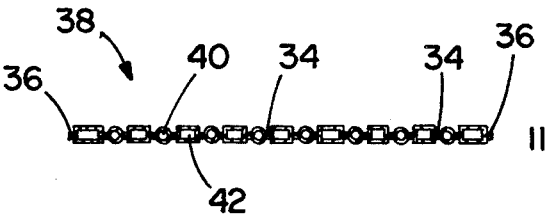
FIG. 3 is a cross-sectional view of FIG. 2 taken along lines A—A showing the refrigerant and air conduits of the double sheet roll bonded laminate of the present invention.
Figure 4:
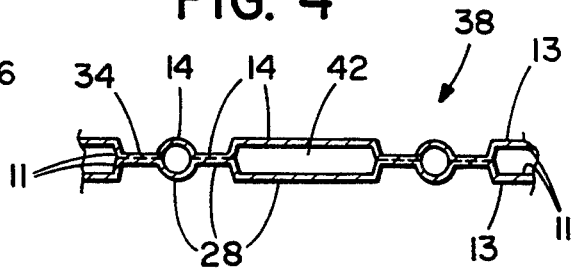
FIG. 4 is an enlarged view showing a section of FIG. 3.

FIGS. 3 and 4 show a cross-sectional view of the welded double sheet roll bonded laminate 38 along lines A—A of FIG. 2. The air conduits 42 generally have a larger cross-sectional surface area than the refrigerant conduits 40 due to the greater heat transfer capacity of the refrigerant. As shown in the enlarged cross sectional view of FIG. 4, the interior weld joints 34 separate the refrigerant conduits 40 from the air conduits 42. Unlike welding methods described in the prior art fin and tube circuitry wherein an intermediate bonding material is interjected between the tube and fin material, the interior welds 34 and perimeter welds 36 of the double sheet roll bond laminate 38 of the present invention are formed from bonding of the non-inked weld areas 22 of the top sheet surfaces 11 of first sheet 14 and second sheet 28 and improve the efficiency of the heat transfer between the integral refrigerant conduits 40 and the air conduits 42.

Figure 5:
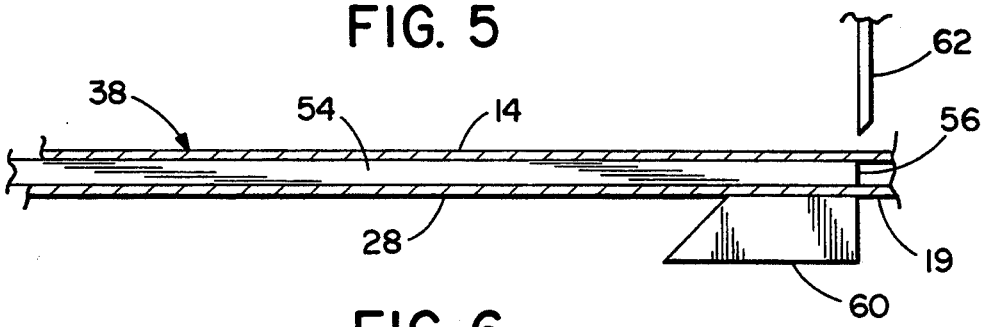
FIG. 5 is a side view showing the fingers of a primary die wherein the air conduits of the double sheet laminate extend over the fingers positioned for lancing.
Figure 6:
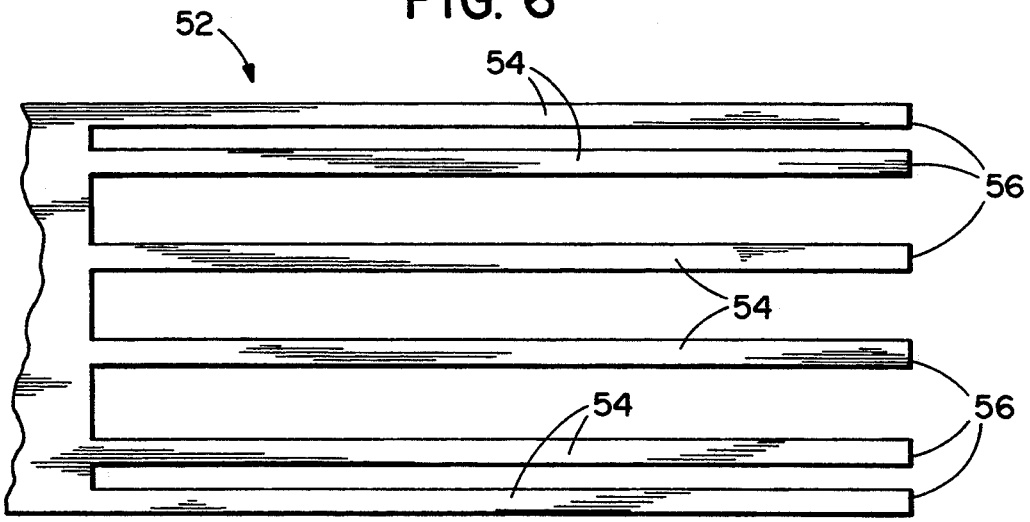
FIG. 6 is a top view of a primary die of the present invention showing a plurality of longitudinal members in a spaced apart relationship aligned parallel to one another and extending outward in the horizontal plane.
Figure 7:
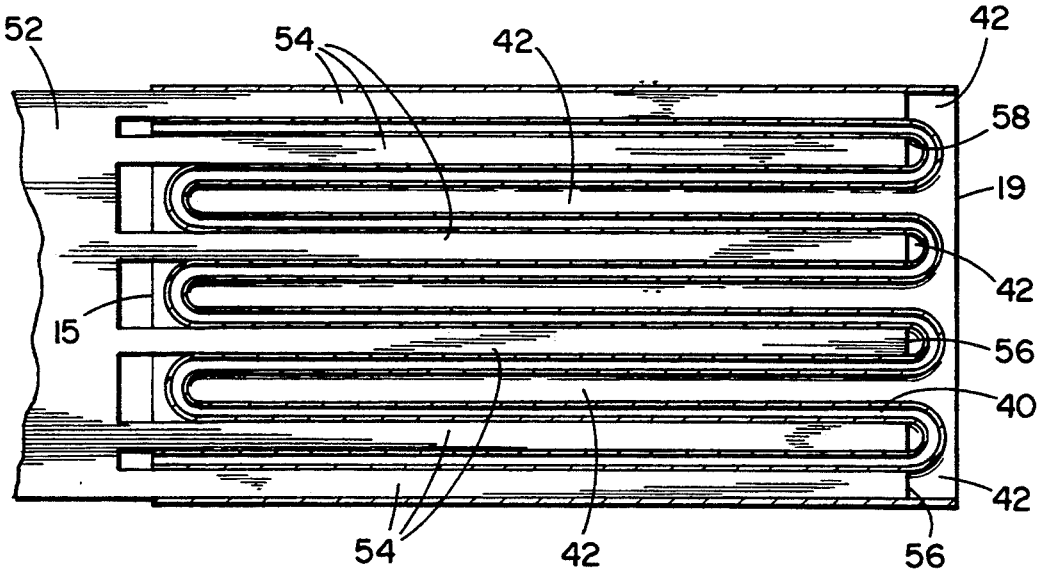
FIG. 7 shows the fingers of the primary die, wherein the air conduits of the double sheet roll bonded laminate extend over the fingers positioned for lancing.
Figure 8:
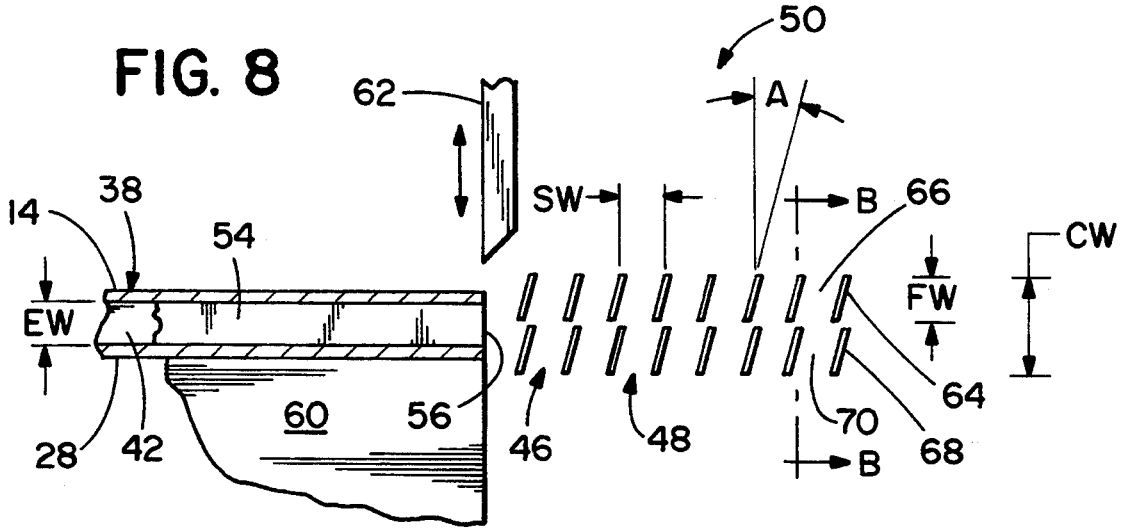
FIG. 8 is a side view of FIG. 5 showing the strip fins formed in the lancing process.

Lancing of the air conduits 42 using a primary and secondary die and punch assembly 50 such as shown in FIG. 5 or 8, forms individual rows of strip fins 46. As best shown in FIG. 6, the primary die 52 includes a plurality of longitudinal members or fingers 54 spaced apart from one another along the horizontal axis. The fingers 54 of the primary die 52 are of a narrower width and thickness than the air conduits 42, and are spaced apart from one another and aligned in order for the air conduits 42 to be extended over the fingers 54 as illustrated in FIG. 7.

The preferred lancing process is accomplished by sliding the first end 15 of the air conduits 42 of the double sheet roll bonded refrigerant laminate 38 over the fingers 54 of the primary die 52 to their full depth so that the distal ends 56 of the fingers 54 are contiguous with the curved portions 58 of the refrigerant conduits 40 as best illustrated in FIG. 7.

The double sheet roll bonded refrigerant laminate 38 is suspended on the fingers 54 of the primary die 52 and positioned with respect to a secondary die 60 and a plurality of transverse reciprocating punch blades 62 so that the distal ends 56 of the primary die fingers 54 are aligned perpendicular to the reciprocating punch blades 62. The reciprocating punch blades 62 are aligned over the air conduits 42 and between the refrigerant conduits 40 of the refrigerant circuit 39. The second end 19 of the double sheet roll bonded refrigerant laminate 38 extends outward pass the distal ends 56 of the primary die fingers 54. The primary die 52 and secondary die 60 operate in cooperative relationship with the transverse reciprocating punch blades 62.

Figure 14:
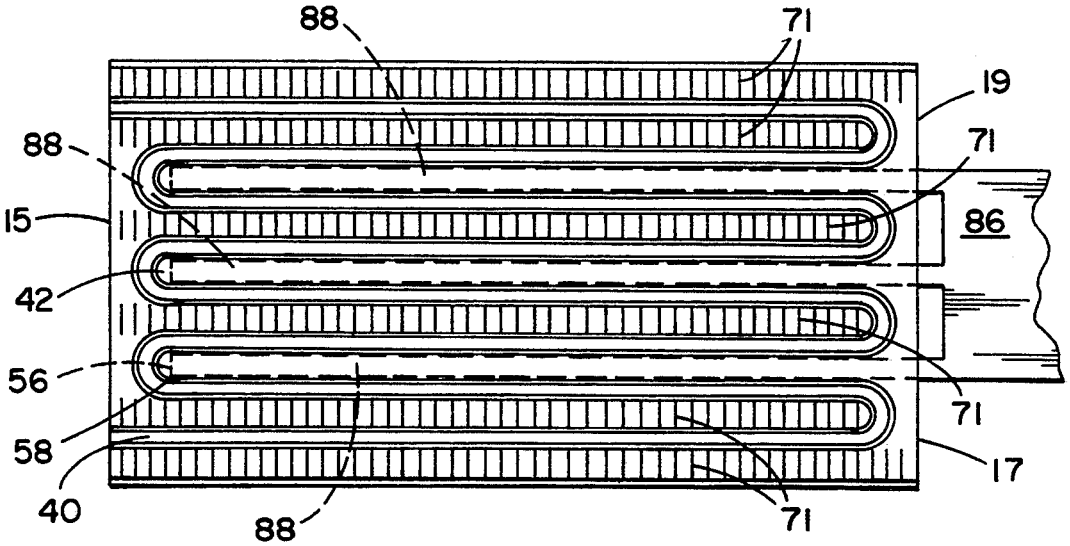
FIG. 14 is a top view showing air conduits of the partially lanced double sheet roll bonded refrigerant heat exchanger circuit extended over the fingers of the primary die.
Figure 15:
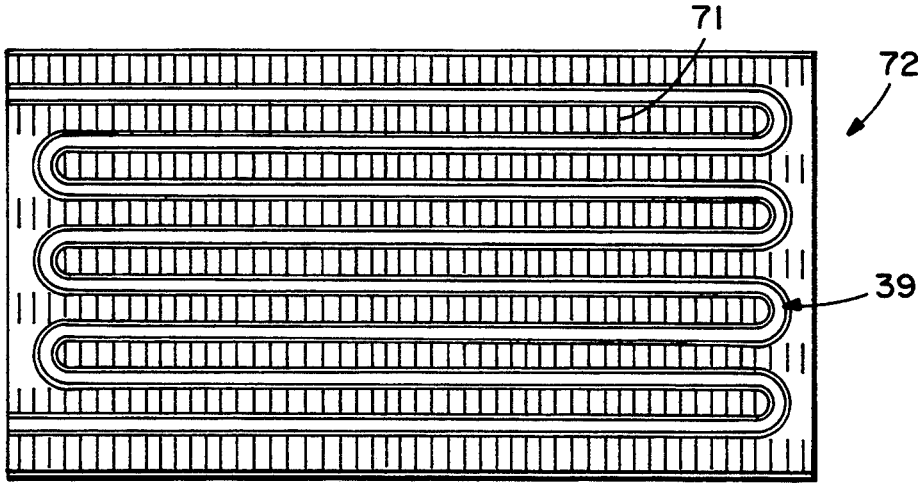
FIG. 15 is a top view showing the lanced double sheet integral roll bonded refrigerant and strip fin heat exchanger circuit of the present invention.

In the lancing process, the punch blades 62 move downward to pierce the first sheet 14 of the air conduits 42 creating a first strip fin 64 and a first slit 66 adjacent thereto comprising the row of strip fins 46 as shown in FIG. 8. The strip fin 64 formed is oriented having the largest portion of the strip fin 64 extending downward and inward, toward the second sheet 28 and having a small portion of the strip fin 64 extending upward past the exterior surface of the first sheet 14. As the punch blade 62 continues through the downward stroke the blade 62 pierces the second sheet 28 forming a second strip fin 68 and a second slit 70 adjacent thereto, wherein the second fin 68 is formed having the largest portion of the strip fin 68 extending downward and outward pass the second sheet surface 28. The punch blade 62 is then retracted and the double sheet roll bond refrigerant laminate 38 is fed forward a predetermined amount for the next stroke. This procedure is repeated until a strip fin circuit 71 as shown in FIGS. 14 and 15 is formed in the double sheet roll bonded refrigerant laminate 38 which is shucked from the primary die 52 as a lanced double sheet integral roll bonded refrigerant tube and strip fin circuit 72.

The strip fin 46 thickness for each layer of strip fins 46 is determined by the initial stock thickness of each sheet 14, 28 of the roll bonded laminate 38. The feed rate of the roll bonded laminate 38 for each stroke of the punch 62 determines the strip fin 46 depth or strip fin 46 width "FW" as the number of fins 46 per inch. The width of each strip fin 46 is inversely proportional to the number of strip fins 46 per inch. For example, producing 16 strip fins 46 per inch results in each strip fin 46 being 1/16th of an inch in width, and producing 32 strip fins per inch results in each strip fin 46 being 1/32th of an inch in width. The number of strip fins 46 per inch is primarily dependent upon the feed rate of the material.

The roll bonded embodiment of the present invention can be lanced producing typically from about six to thirty strip fins per inch in roll bonded material having a sheet thickness of from about 20 to 30/1,000 of an inch thick. For instance, lancing of the air conduits 42 of the preferred roll bonded embodiment forms miniature strip fins 46 ranging from about 0.030 inches to about 0.166 inches in width.

Because the roll bonded heat exchanger circuit 38 is comprised of two sheets 14 and 28 providing two layers of strip fins 46, twice as many strip fins 46 per inch are formed in the roll bonded heat exchanger circuit 38 of the present invention as conventional welded tube and fin circuits. As shown in FIG. 8, the overall thickness or depth defining the overall heat exchanger circuit width ("CW") of the lanced integral roll bonded refrigerant tube and strip fin heat exchanger circuit is determined by the width "FW" of the strip fins 46 (which is dependent upon the number of strip fins 46 per inch); the expanded width, "EW", defining the distance between the roll bonded sheets 14, 28 comprising the laminate (which is dependent upon the desired thickness of the expanded portions of the roll bonded laminate formed in the roll bonding process); and the number of sheets comprising the roll bonded laminate 38. As will be discussed subsequently, additional sheets of material can be used to construct roll bonded laminates comprising more than two sheets of material.

The strip fins 46 of the lanced double sheet integral roll bonded refrigerant tube and strip fin heat exchanger circuit 72 of the present invention provides a heat transfer coefficient ("h") of from about three to five times that of a single continuous fin extending longitudinally across a single refrigerant conduit. Roll bonded laminates having a greater number of sheets provide even greater heat transfer area.

The slit width "SW" of the slits 66, 70 forming the spacing distance between the strip fins 64, 68 is determined by the strip width and strip angle. The feed rate of the material being lanced controls the strip fin width and pitch. As the punch blade 62 extends downward piercing the first and second sheets 14 and 28, respectively, the strip fin side portions 76 are twisted at an acute angle and the central portions 78 of strip fins 64 and 68 are sheared and twisted generally perpendicular to the surface of sheets 14 and 28 for strip fin pitch of about ten strip fins 46 per inch and above. From the range of about ten strip fins 46 per inch to about six strip fins 46 per inch, angle "A", as shown in FIG. 8, ranges from about zero to about thirty degrees from the vertical axis normal to the surface of the fin strip.

Figure 9:
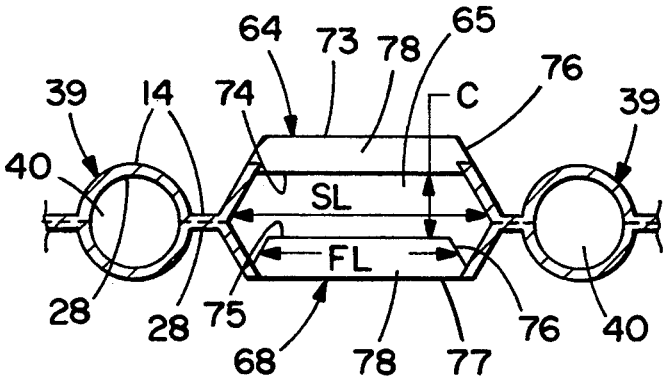
FIG. 9 is a cross-sectional view of FIG. 8 taken along lines B—B, showing the fins formed between a pair of refrigerant conduits of the double sheet roll bonded strip fin and refrigerant heat exchanger circuit of the present invention.

As illustrated in FIG. 9, a cross-sectional view of FIG. 8 taken along lines B—B shows the strip fin length "FL" and slit length "SL" are determined by the width of the air conduits 42 between the refrigerant conduits 40. The strip fin length is an important design criteria selected to provide typically a fin effectiveness of about 85 percent.

Figure 10:
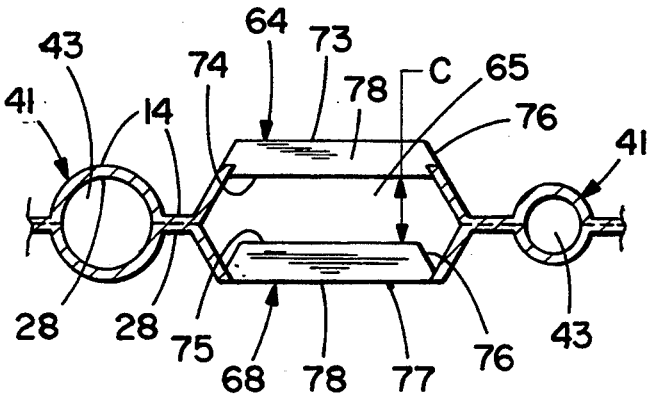
FIG. 10 is a cross-sectional view of FIG. 8 taken along lines B—B, showing the strip fins formed in a fin strip between a pair of tapered refrigerant conduits of the double sheet roll bonded strip fin and refrigerant heat exchanger circuit of the present invention.

With regard to FIGS. 9 and 10, additional surface area is also generated by the first strip fin exterior edge 73, first strip fin interior edge 74, second strip fin interior edge 75, and second strip fin exterior edge 77 of the strip fins 46, (6% for six strip fins per inch) and (20% for 33 strip fins per inch). The width ("C") of the air conduit channel 65 formed between the first strip fin interior edge 74 and the second strip fin interior edge 75 of the preferred roll bond embodiment is approximately 30% of the expansion width "EW" for a six strip fin per inch, and increases to about 75% of EW for a 33 strip fin per inch. As the number of strip fins per inch is decreased and the strip fin width ("FW") is increased the width ("C") of the air conduit channel 65 is decreased accordingly. The continuity of material for the strip fins, weld transition, and integrally formed tubular refrigerant and air conduits provides an adequate condensation drainage surface.

The cross-sectional view of the double sheet integral roll bonded refrigerant tube and strip fin heat exchanger circuit 72 is shown in FIG. 9 having a refrigerant circuit 39 formed with round tubular refrigerant conduits 40 of uniform diameter. However, as shown in FIG. 10, the refrigerant conduits may be roll bonded having varying diameters with air conduits 42 of constant widths. The roll bonding refrigerant and strip fin forming process as described in the present invention provides a means for forming refrigerant circuits 41 having tapered refrigerant conduits 43. Varying the cross-sectional area of the conduits by tapering and/or expanding the refrigerant conduits 43 provides a means to control the velocity of the refrigerant and reduce pressure drop in the refrigerant circuit 41 to prevent the necessity to branch the refrigerant circuit as is customary with existing tube and fin refrigerant circuits having refrigerant conduits of uniform diameter.

Figure 11:
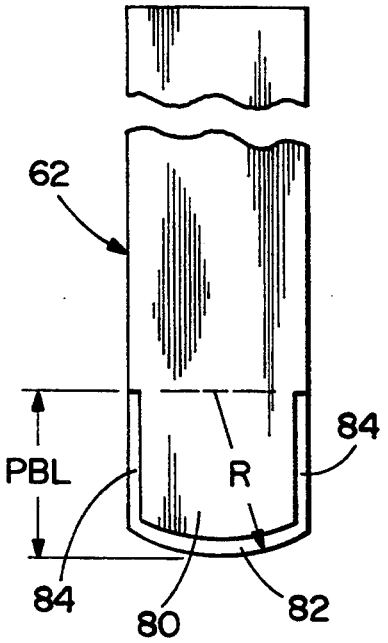
FIG. 11 is an elevated front view showing the punch of FIG. 8.
Figure 12:
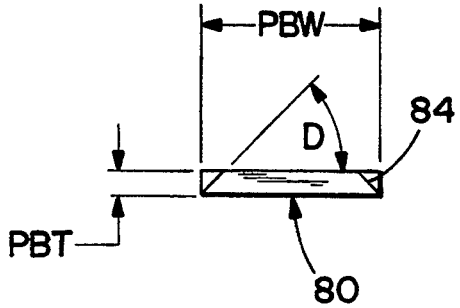
FIG. 12 is an elevated end view showing the punch of FIG. 11.

The punch blade 62 of the present invention has a front and rear planar surface, a pair of side edges connecting the front and rear planar surfaces, and an end edge connecting the front and rear planar surfaces with the side edges. As shown in FIGS. 11 and 12, the punch blade 62 selected for forming the preferred embodiment has a formed punch blade length ("PBL") of about one laminate thickness greater than the number of expanded laminates forming the roll bonded air conduits 42 to be lanced, (or a blade length of about one layer thickness greater than the number of extrudate layers forming the extruded air conduits as discussed subsequently). The thickness ("PBT") of the punch blade 62 is about 1/16th of an inch in thickness. The width of the punch blade ("PBW") is selected to form the desired strip fin 46 length "FL" to provide optimal heat transfer and the requisite structural support to the lanced double sheet roll bonded refrigerant and strip fin heat exchanger circuit 72. The punch tip 80 is rounded having a radius ("R") equal to the width of the air conduit 42. The end edge 82 and connecting side edges 84 of the punch blade tip 80 are beveled from the front backward at about 25 to 35 degrees, preferably about 30 degrees as indicated by Angle "D". The radius, and the end and side bevel dimensions are critical parameters to be determined to lance the roll bonded laminate 38 and form strip fins 64, 68, and yet prevent tearing of the corners of the slits 66, 70 of the air conduit 42 as shown in FIG. 9.

After the lancing process has created a strip fin circuit 71 in the portion of the air conduits 42 extending form the second end 19 of the double sheet integral refrigerant tube and strip fin heat exchanger circuit 72 as shown in FIG. 14, the portion of the air conduits 42 extending from the first end 15 of the integral refrigerant tube and strip fin heat exchanger circuit 72 is lanced using a primary and secondary die and punch assembly 86 similar to the assembly shown in FIG. 5.

Figure 13:
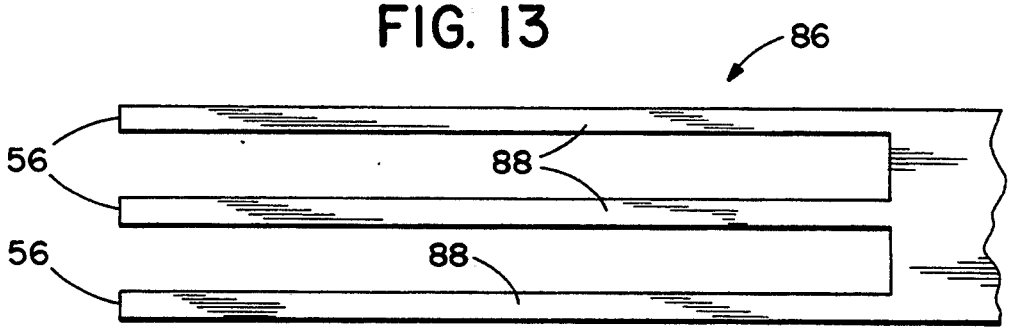
FIG. 13 is a top view of a primary die of the present invention showing a plurality of longitudinal members in a spaced apart relationship aligned parallel to one another and extending outward in the horizontal plane.

As shown in FIG. 13, the primary die 86 includes a plurality of spaced apart longitudinal members or fingers 88 as does the primary die 52; however, the fingers 88 are spaced apart according to the spacing of the air conduits 42 which extend inward from the second end 19 toward first end 15. The fingers 88 of the primary die 86 are of a narrower width and thickness than the air conduits 42, and are spaced apart from one another and aligned to be insertable within the air conduits 42 as illustrated in FIG. 14.

The primary die 86 and secondary die 60 are fixed in stationary alignment with a plurality of punches 62. The portion of the air conduits 42 extending from between the curved portions of the refrigerant conduits 40 and toward the second end 17 of the partially lanced integral refrigerant tube and strip fin heat exchanger circuit 72 is threaded over the stationary fingers 88 of the primary die 86 to their full depth so that the distal ends 56 of the fingers 88 are contiguous with the curved portions 58 of the refrigerant conduits 40 as best illustrated in FIG. 14.

As described previously and illustrated in FIG. 5, the lancing process to form the strip fins 46 in the air conduits 42 of the first end 15 of the partially lanced double sheet roll bonded refrigerant tube and strip fin heat exchanger circuit 72 is the same as previously described for forming strip fins 46 in the second end of the roll bonded laminate 38. The first end 15 extends outward pass the distal ends 56 of the primary die fingers 88. The primary die 86 and secondary die 60 operate in cooperative relationship with the transverse reciprocating punch blades to lance the material forming first strip fins 64, second strip fins 68, first slits 66, and second slits 70 therein. This procedure is repeated until a complete strip fin circuit 71 is formed in the remaining air conduits 42 extending from the first end 15 to complete the double sheet integral roll bonded refrigerant tube and strip fin heat exchanger circuit 72 as shown in FIG. 15.

An alternate roll bonded embodiment of the present invention comprises a quadruple "four" sheet roll bonded integral refrigerant tube and strip fin heat exchanger circuit 100. As with the double sheet integral refrigerant tube and strip fin heat exchanger circuit 72, the roll bond manufacturing process and design for the quadruple sheet integral refrigerant tube and strip fin heat exchanger circuit 100 is substantially the same as described for the two sheet process except for the application of the no-weld ink 12.

The process of manufacture for the quadruple sheet integral refrigerant tube and strip fin heat exchanger circuit 100 is different from the double sheet roll bonded integral refrigerant tube and strip fin heat exchanger circuit 72, in that no weld ink 12 is applied to selected top surfaces of additional intermediate stock sheets before the heat and pressure roll bonding process. The quadruple sheet roll bond integrated tube and strip fin heat exchanger circuit 100 utilizes four blank aluminum exterior stock sheets, a first exterior sheet 101, a second intermediate sheet 102, a third intermediate sheet 103, and a fourth exterior sheet 104.

All of the thermally conductive sheets of material 101–104 have a thickness of about 0.025 to 0.035 of an inch, and preferably about 0.030 of an inch before the roll bonding process. Each sheet of heat transfer material is reduced in thickness to one half as thick (0.010 to 0.020 of an inch, preferably 0.015 of an inch) thick after the roll bonding process to double the air side heat transfer surface area. Thinner sheets could be used in the roll bonding process; however, the thickness of the sheets are selected in accordance with producing a finished product having a total refrigerant conduit wall thickness in the range of 0.020 to 0.030 of an inch, and preferably 0.025 of an inch thick to contain from 300 to 700 pounds per square inch of refrigerant pressure, to meet present Underwriter Laboratories standards.

Figure 16:
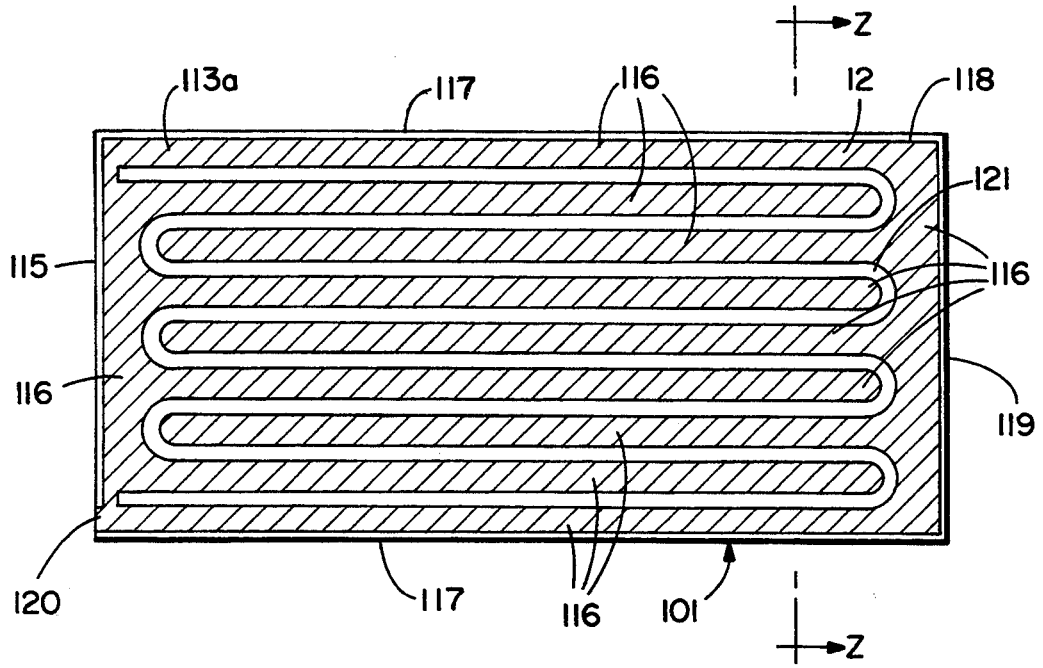
FIG. 16 is a top view of the bottom surface of the first exterior sheet of the inked quadruple layer sheet sandwich showing the dark shaded no-weld inked surfaces and the light to-be-welded surface areas.
Figure 20:
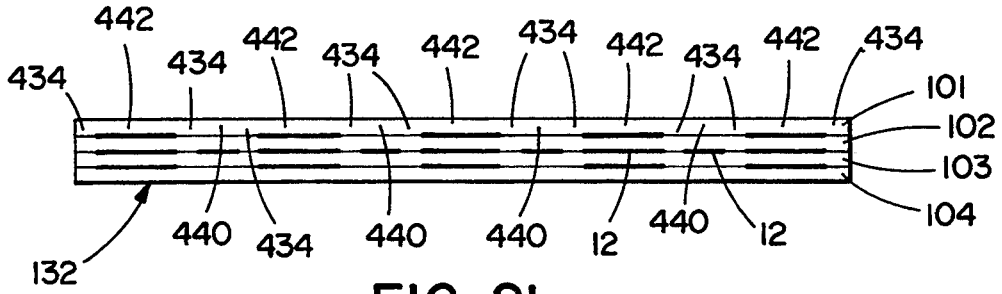
FIG. 20 is an end view of the inked sheets aligned and placed together forming a quadruple layer sheet sandwich in preparation for the roll bonding process.

As shown in FIGS. 16 and 20, the first exterior sheet 101 has a first sheet top surface **111*a*, a first sheet bottom surface 113*a*, a first end 115, opposing sides 117, and a second end 119. As shown in FIG. 16, no-weld ink 12 is applied to the no-weld "dark-shaded" areas 116 of the first exterior sheet bottom surface 113*a* to form an inked parameter weld-line 118 drawn around the edge of the no-weld area 116 leaving a small connector opening 120 at one corner. Application of the no-weld ink 12 to selected interior portions of the first sheet bottom surface 113*a* form a continuous serpentine shaped refrigerant circuit pattern 124 outlined on the bottom surface 113*a* of the first exterior sheet 101**.

Figure 17:
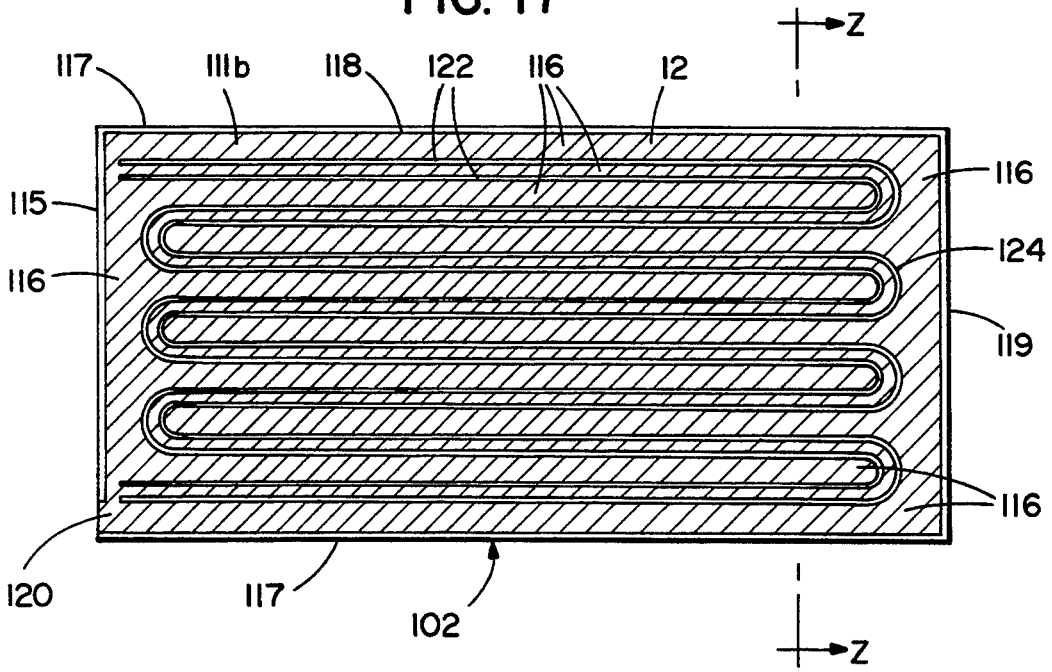
FIG. 17 is a top view of the bottom surface of the second intermediate sheet of the inked quadruple layer sheet sandwich showing the dark shaded no-weld inked surfaces and the light to-be-welded surface areas.

A second intermediate companion sheet 102 of the same size and thickness as the first sheet 101 is shown in FIGS. 17 and 20. The second intermediate sheet 102 has a second sheet top surface **111*b*, a second sheet bottom surface 113*b*, a first end 115, opposing sides 117, and a second end 119. The second sheet top surface 111*b* is aligned and placed in contact with the inked surface of the first sheet bottom surface 113*a* of sheet 101. No-weld ink 12 is applied to the no-weld "dark-shaded" areas 116 of the second intermediate sheet bottom surface 113*b* in the same manner as applied to the bottom surface of 113*a* of the first exterior sheet 101 to form a serpentine shaped refrigerant circuit pattern 124 on the bottom surface of 113*b* as a mirror image of the serpentine pattern 124 outlined on the bottom surface 113*a* of the first exterior sheet 101**.

In addition, as shown in FIGS. 17 and 20, no-weld ink 12 is applied to the no-weld "dark-shaded" areas 116 of the second intermediate sheet bottom surface **113*b* between the spaced apart pair of non-inked interior weld lines 22 within the serpentine shaped refrigerant circuit pattern 124 between the second sheet bottom surface 113*b* and the third sheet top surface 111*c* for forming an expandable area for a refrigerant conduit 40** thereinbetween.

Figure 18:
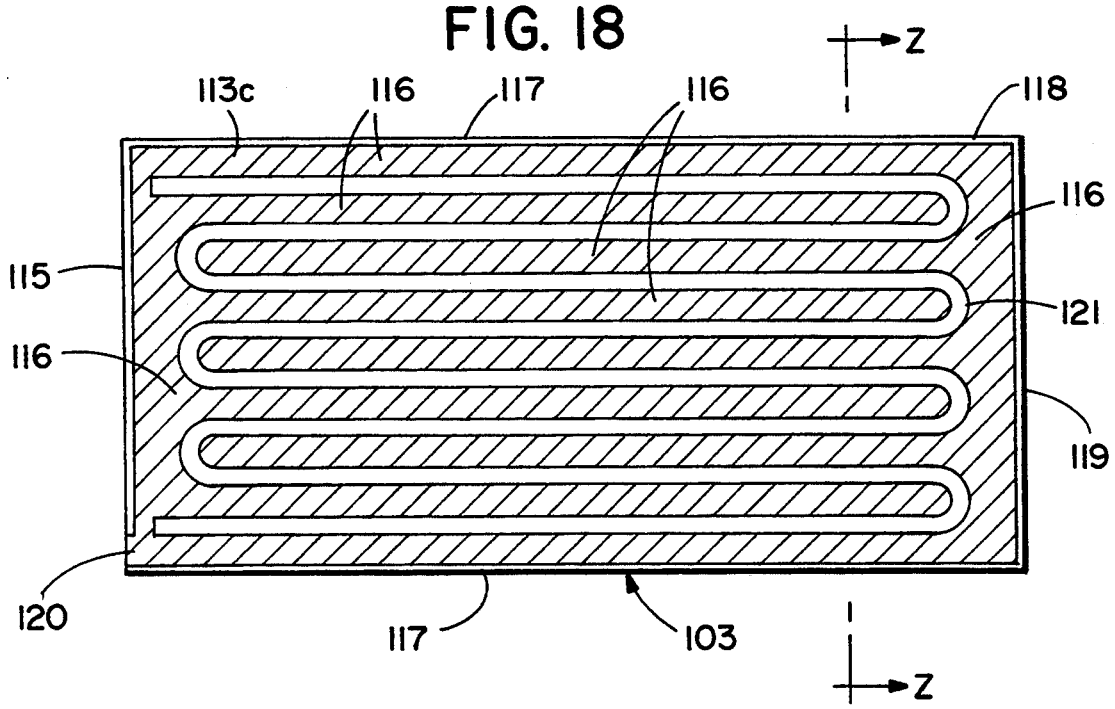
FIG. 18 is a top view of the bottom surface of the third intermediate sheet of the inked quadruple layer sheet sandwich showing the dark shaded no-weld inked surfaces and the light to-be-welded surface areas.

A third intermediate companion sheet 103 of the same size and thickness as the first sheet 101 is shown in FIGS. 18 and 20. The third intermediate sheet 103 has a third sheet top surface **111*c*, a third sheet bottom surface 113*c*, a first end 115, opposing sides 117, and a second end 119. The third sheet top surface 111*c* is aligned and placed in contact with the inked surface of the second sheet bottom surface 113*b* of sheet 102. No-weld ink 12 is applied to the no-weld "dark-shaded" areas 116 of the third intermediate sheet bottom surface 113*c* in the same manner as applied to the bottom surface of 113*a* of the first exterior sheet 101 to form a serpentine shaped refrigerant circuit pattern 124 on the bottom surface of 113c as a mirror image of the serpentine pattern 124 outlined on the bottom surface 113a of the first exterior sheet 101**.

A fourth exterior companion blank sheet 104 (not shown) of the same size and thickness as the first sheet 101 and having a fourth sheet top surface 111d is aligned and placed in contact with the inked surface 113c of sheet 103.

As shown in FIG. 20, an inked quadruple layer sheet 132 is formed by the alignment and placing together of the inked no-weld surface areas of inked sheets 101 102, 103, and 104. No-weld ink 12 separates sheets 101 and 102 in the no-weld areas 442 which will be expanded to form the air conduits 142. Sheets 102 and 103 are separated by no-weld ink 12 in the no-weld areas 442 which will be expanded to form the air conduits 142 and the no-weld areas 440 which will be expanded to form the refrigerant conduits 140. Sheets 103 and 104 are separated by no-weld ink 12 in the no-weld areas 442 which will be expanded to form the air conduits 142.

The inked quadruple sheet 132 is heated to approximately 600° F., and moved through a rolling mill under high pressure in the same manner as the process described for the inked double sheet layer 32. After rolling to 40% of the original thickness in the bonding process the no-ink welded portion of the quadruple sheet roll bonded laminate 138 will be about 0.025 inches thick, and on each side of the refrigerant conduit area 440 the unwelded portion of each sheet 101–104 will be about 0.0125 inches thick in the air conduit areas 442. The high pressure reduces the thickness of the inked quadruple sheet 132 by approximately 60% so that the non-ink-treated weld line surfaces 118 and 122 of sheets 101–104 are hermetically bonded together forming a welded quadruple sheet roll bonded laminate 138 having interior weld joints 134, end perimeter weld joints 135, and side perimeter weld joints 136 as shown in FIG. 21.

As with the double sheet roll bonded laminate 38, the quadruple sheet roll bonded heat exchanger circuit 138 is then placed between a pair of platens and connected to a pressurized gas supply means via the connector opening 120. The no-ink unwelded surface areas 116 are expanded (inflated between platens) with a high pressure gas such as nitrogen or air to a predetermined amount forming a continuous refrigerant conduit 140 between the interior welds 134, and air conduits 142 between the interior welds 134 of the refrigerant conduit 140 and the perimeter welds 135 and 136. Expansion of the quadruple sheet roll bonded laminate 138 forms refrigerant conduits 140 in a continuous serpentine pattern defining a quadruple sheet roll bonded refrigerant heat exchanger circuit 139 within the quadruple sheet roll bonded laminate 138. The quadruple sheet roll bonded laminate 138 provides the necessary tube wall thickness for structural support while allowing thinner strips of material to be used for the strip fins 146, thereby providing twice the heat transfer capability of the double sheet tube and fin heat exchanger circuits.

Figure 21:
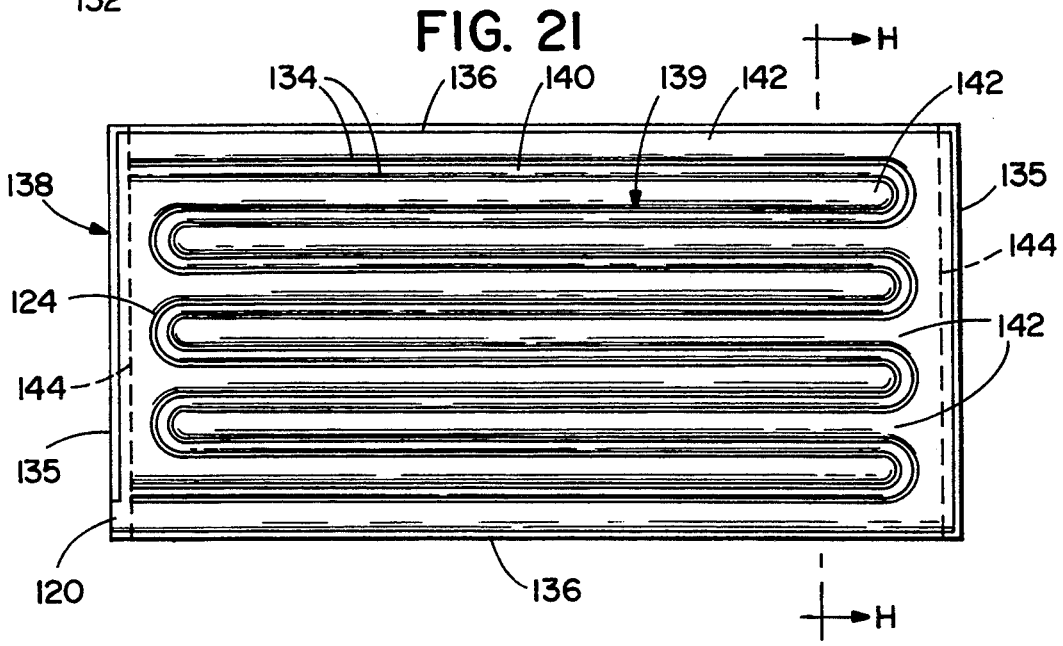
FIG. 21 is a top view of the quadruple sheet roll bonded laminate showing the refrigerant and air conduits of the present invention.

The quadruple sheet roll bonded laminate 138 shown in FIG. 21 comprises four pairs of upper and lower surfaces of air conduits 142 about 0.0125 inches thick, and two pairs of roll bonded interior weld joints 134 about 0.025 inches thick. The end perimeter weld joints 135 positioned normal to the curved portions of the roll bonded refrigerant pattern 124 are trimmed according to perforation lines 144 providing access to the air conduits 142 for the lancing process.

Figure 22:
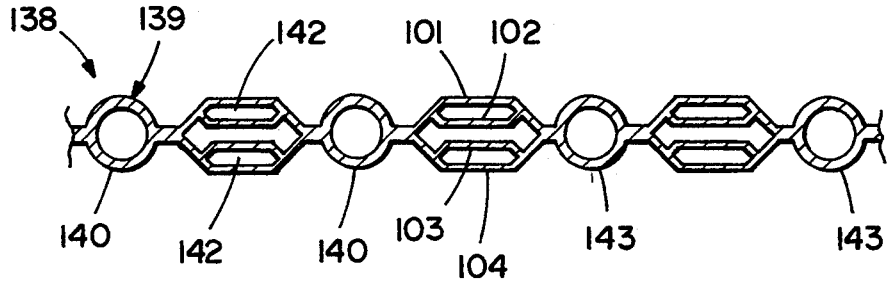
FIG. 22 is a cross-sectional view of FIG. 21 along lines H—H showing the quadruple sheet roll bonded laminate of FIG. 21.

FIG. 22 shows a cross-sectional view of the quadruple sheet roll bonded heat exchanger circuit 138 along lines H—H of FIG. 21. The air conduits 142 generally have a larger cross-sectional surface area than the refrigerant conduits 140 and tapered refrigerant conduits 143 due to the greater heat transfer capacity of the refrigerant. The quadruple sheet roll bonded heat exchanger circuit 138 provides refrigerant conduits 140 and air conduits 142 which vary in diameter providing for custom designs for particular applications. Tapering and/or expanding the cross-sectional area of the refrigerant circuit 143 provides a means for maintaining optimum velocity of the fluid while maintaining pressure.

Figure 23:
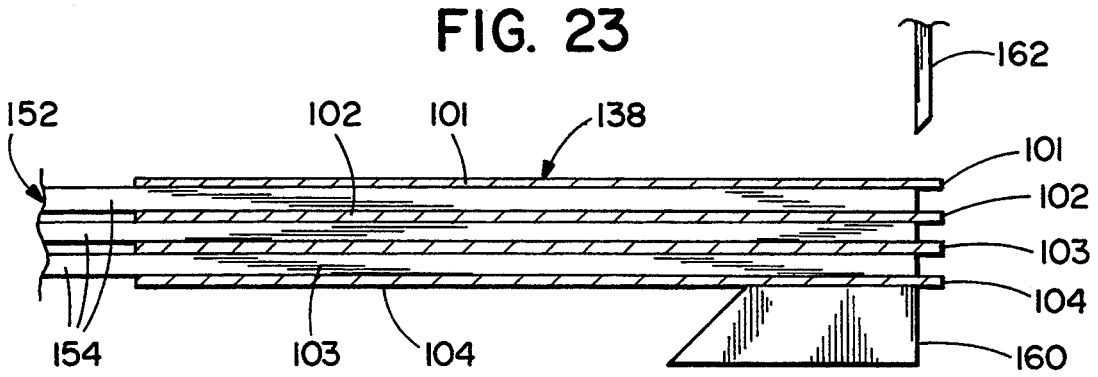
FIG. 23 is a side view showing a triple layer punch and die assembly wherein air conduits of the quadruple sheet roll bonded laminate are extended over the vertically stacked fingers of a primary die positioned for lancing.

The lancing process to form the strip fins 146 and slits 148 in the air conduits 142 is generally the same for the quadruple sheet roll bonded heat exchanger circuit 138 as for the double sheet roll bonded laminate 38; however, the primary die 152 includes three vertically stacked longitudinal members or fingers 154 aligned in a cooperative relationship with the secondary die 160 and punch 162 as illustrated in FIG. 23. Moreover, punching four sheets of strip fins 146 and slits 148 per stroke requires about the same amount of time as for punching two sheets of strip fins 46 and slits 48. Feed and strip fin pitch relationships are also about the same. Punch presses are available with stroke speed of 800 strokes per minute to enhance production volume.

Figure 24:
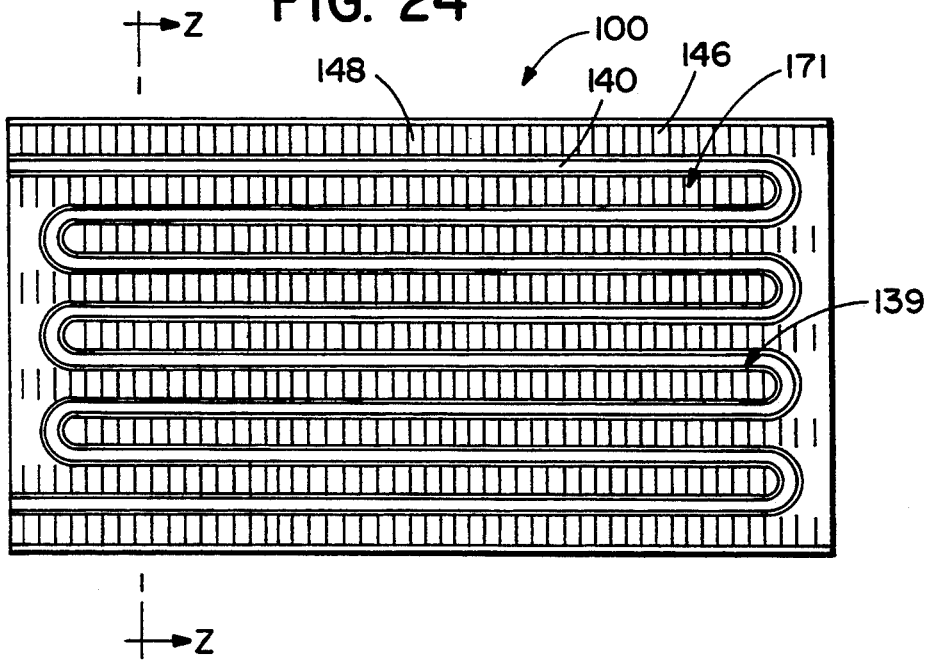
FIG. 24 is a top view of a quadruple sheet roll bonded refrigerant tube and strip fin heat exchanger circuit of the present invention.

FIG. 24 shows the lanced quadruple sheet integral roll bonded refrigerant tube and strip fin heat exchanger circuit 100 after the lancing process forming the strip fins 146 and slits 148.

Figure 25:
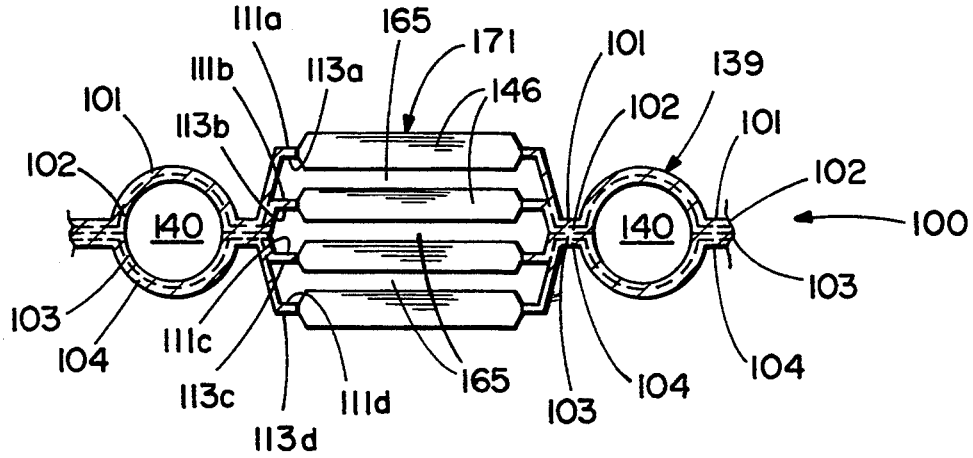
FIG. 25 is an enlarged cross-sectional view taken along lines Z—Z showing a section of FIG. 24.

FIG. 25 is an enlarged cross sectional view of FIG. 24 along lines Z—Z showing the lanced quadruple sheet integral roll bonded refrigerant tube and strip fin heat exchanger circuit 100 after the lancing process forming the strip fins 146 and slits 148. The heat exchanger circuit 100 has a refrigerant circuit 139 with generally round tubular refrigerant conduits 140, and a strip fin circuit 171 including four layers of strip fins 146 separated by three layers of air conduit channels 165 thereinbetween.

Moreover, FIG. 25 shows the refrigerant circuit 139, wherein the interior surface of the refrigerant conduit 140 is comprised of the bottom surface 113b of the second intermediate sheet 102 being bonded to the top surface 111c of the third intermediate sheet 103.

Furthermore, the refrigerant circuit 139 and strip fin circuits 171 are integrally joined together by interior weld joints 134 roll bonded together and comprising the bottom surface 113a of the first exterior sheet 101 bonded to the top surface 111b of the second intermediate sheet 102, the bottom surface 113b of the second intermediate sheet 102 bonded to the top surface 111c of the third intermediate sheet 103, and the bottom surface 113c of the third intermediate sheet 103 bonded to the top surface 111d of the fourth exterior sheet 104.

Using additional thinner sheets of heat transfer material provide twice the number of air side strip fins 146 while maintaining the same refrigerant conduit 140, 143 wall thickness at the interior weld joints 134 and the side perimeter weld joints 136 as the double sheet roll bonded integral refrigerant tube and strip fin heat exchanger circuit 72 to increase strip fin heat transfer surface area.

The double sheet or quadruple sheet roll bonded integral refrigerant tube and strip fin heat exchanger circuits, 72 and 100, respectively, form one piece heat exchanger circuits for optimizing heat transfer in applications primarily targeted toward air conditioners and single package central air conditioning systems.

Figure 26:
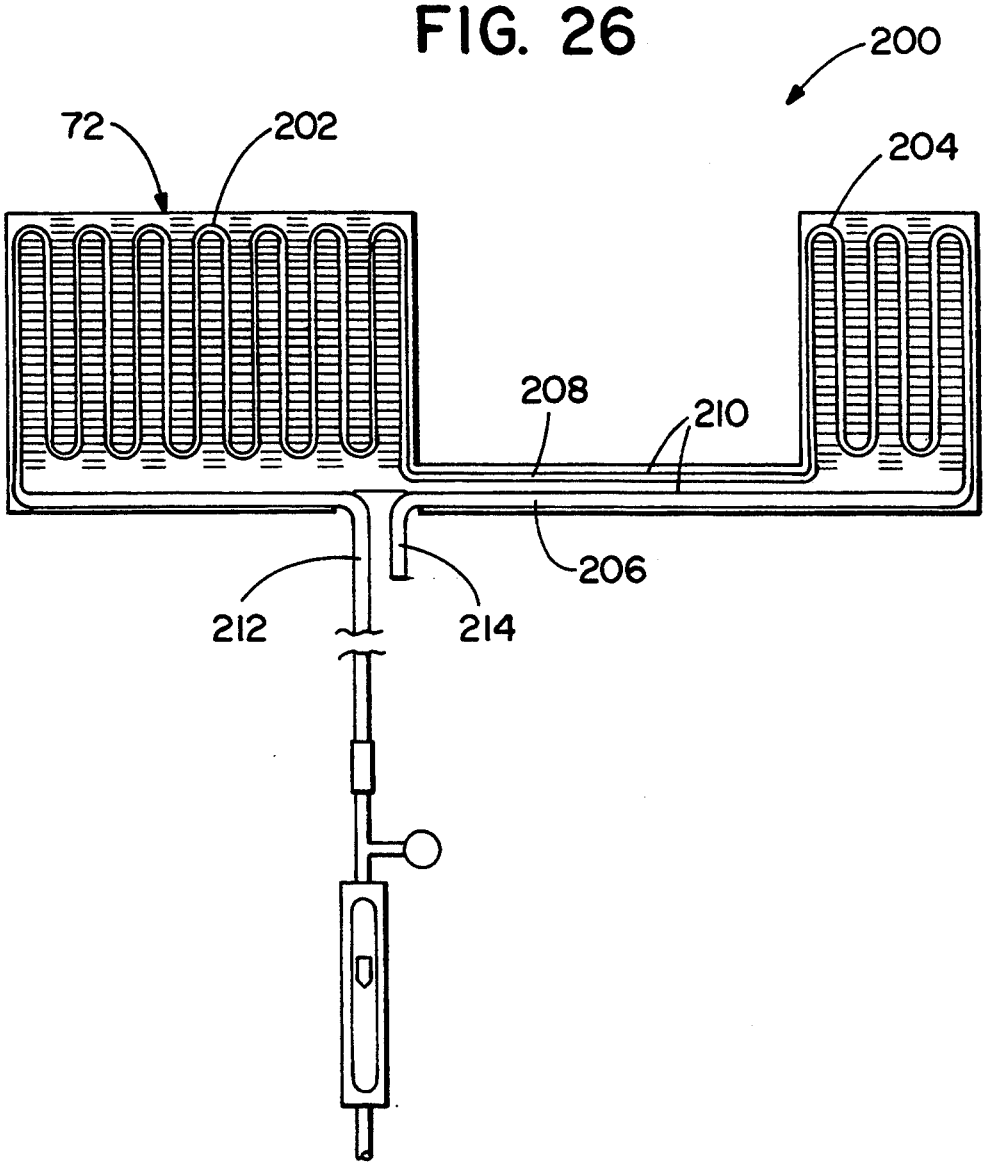
FIG. 26 is a top view of a composite refrigeration system comprising a condenser, evaporator, metering tube, an integral suction conduit, constructed from a roll bonded multiple sheet integral refrigerant tube and strip fin heat exchanger circuit.

As shown in FIG. 26, a one piece composite refrigeration system 200 can be formed having a condenser 202 and an evaporator 204 connected by a suction tube 206 and liquid line metering tube 208 formed within an umbilical circuit strip 210 constructed from a single integrally formed multi-sheet assembly, such as a double sheet roll bonded integral refrigerant tube and strip fin heat exchanger circuit 72. The complete one piece refrigeration system 200 is formed from a roll bonded heat exchanger circuit 72 without joints except for compressor discharge connecting tube 212 and compressor suction connecting tube 214 eliminating potential leaks and improving quality.

A major advantage of using the double sheet roll bonded integral refrigerant tube and strip fin heat exchanger circuits 72 of the present invention is the ability to form tapered refrigerant conduits 43 within the refrigerant circuit 39 of the integral refrigerant tube and strip fin heat exchanger circuits 72 to eliminate the need for additional circuitry with branching lines. The roll bonded integral tube and strip fin heat exchanger circuit provides a means to control the velocity of the refrigerant and reduce pressure drop in the refrigerant conduit is by varying the cross-sectional area of the conduits by tapering and/or expanding the integrally formed refrigerant conduits. The tapered refrigerant conduit 43 may be formed having continuously tapering from one end to the other end, formed having tapered sections integrally joined with sections of uniform diameter, or formed having a plurality of integrally formed sections of varying diameters.

Figure 27:
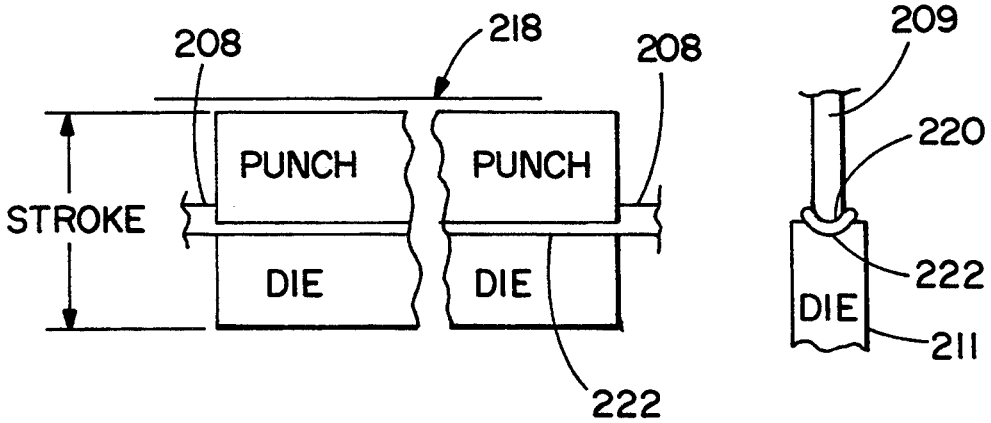
FIG. 27 is a punch and die assembly for forming metering tube as an integral part of the composite refrigeration system of FIG. 26.

The refrigerant system 200 shown in FIG. 26 includes a metering tube 208 formed as an integral tube within the double sheet roll bonded integral refrigerant tube and strip fin heat exchanger circuits by the roll bond process. As shown in FIG. 27, the preferred method of reforming and calibrating the metering tube 208 is by a variable stroke punch and die assembly 218 including a punch 209 and die 211, wherein the semicircular shaped punch nib 220 is forced onto the metering tube 208 squeezing the entire length between the condenser 202 and the evaporator 204 while directing a source of dry air through the roll bonded integral refrigerant tube and strip fin heat exchanger circuits 72, 100, until the flow and pressure reaches a preselected pressure and flow rate as set forth in U.S. Pat. No. 3,967,489 incorporated herein. Forming the metering tube restrictor 222 in a curvilinear shape leaves it in a pressure stable configuration for infinite life.

The ability to utilize a tapered refrigerant conduit 43 in the refrigerant circuit 39 permits the use of a single continuous system eliminating the need for a more expensive copper capillary and suction lines or the need to solder these components together. It also eliminates many joints and more specifically copper aluminum joints and their corrosion potential. Unitizing the metering and suction tubes provides maximum heat transfer between the two and eliminates the possibility of freeze-thaw separation, a common problem with current practice of joining the two by solder.

Therefore, the refrigerant system 200 of the present invention provides an integral tube and strip fin heat exchanger circuit for optimum heat transfer, a means to control refrigerant velocity within a single refrigerant tube, a one piece assembly to eliminate joints and prevent leaks, an integral suction/metering tube for maximum heat transfer and to prevent freeze-thaw separation, low cost, a means of eliminating galvanic corrosion caused by use of dissimilar materials of construction, and a means of providing various metering requirements within a single circuit.

Figure 28:
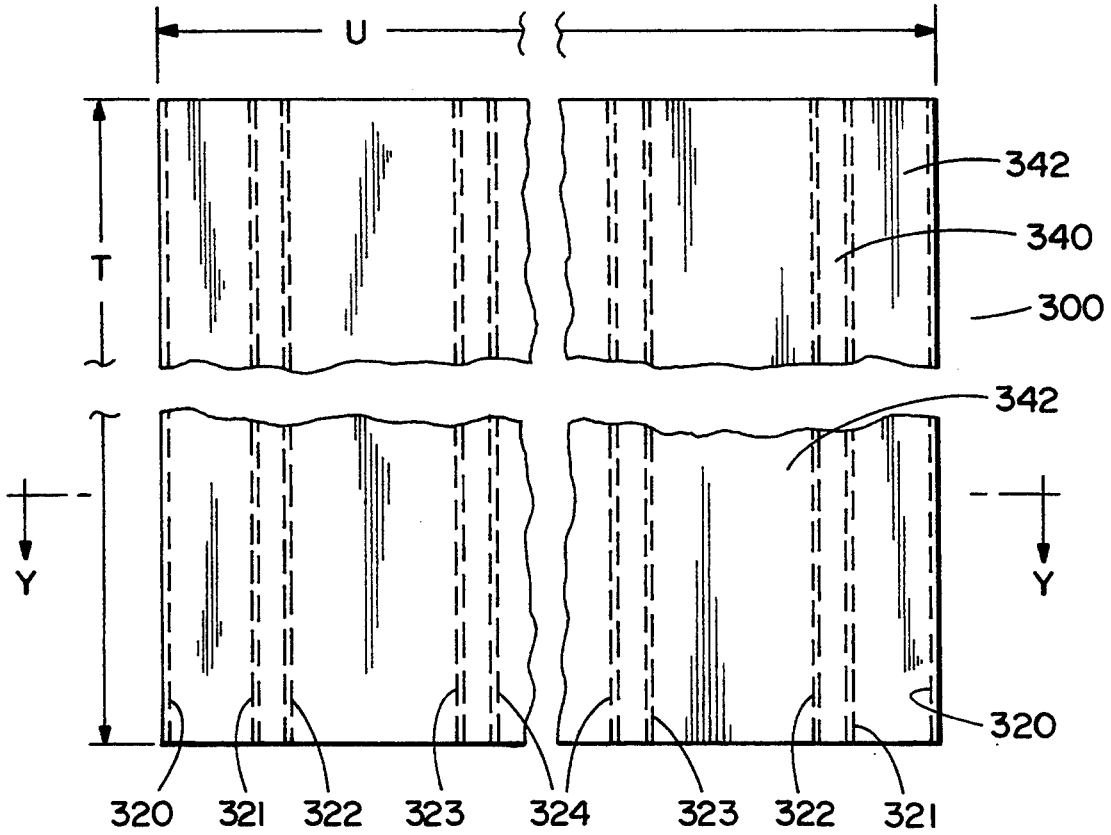
FIG. 28 is a top view showing a multiply layer extrudate of the present invention.

An extruded aluminum embodiment of the present invention is shown in FIGS. 28 in phantom lines, as a multiply layer extrudate 300 having a plurality of refrigerant conduits 340 and air conduits 342 sharing common interior sidewalls. The multiply layer extrudate 300 comprises spaced apart horizontal layers separated by a plurality of interior vertical refrigerant conduit sidewalls 321–324 (shown in phantom lines) disposed between exterior vertical air conduit sidewalls 320 and spaced apart from one another along the horizontal axis. The multiply layer extrudate 300 may be formed in any desired width ("U") and cut into any desired length ("T").

Figure 29:
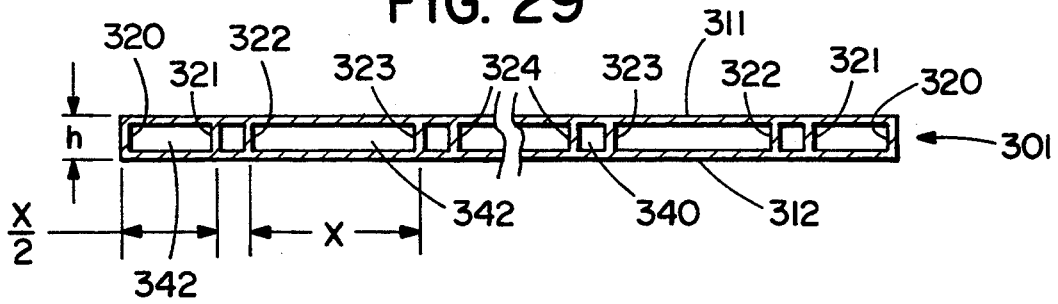
FIG. 29 is a cross-sectional view along line Y—Y of an embodiment of FIG. 28 showing a double layer refrigerant tube extrudate of the present invention having generally rectangular refrigerant conduits and air conduits.
Figure 30:
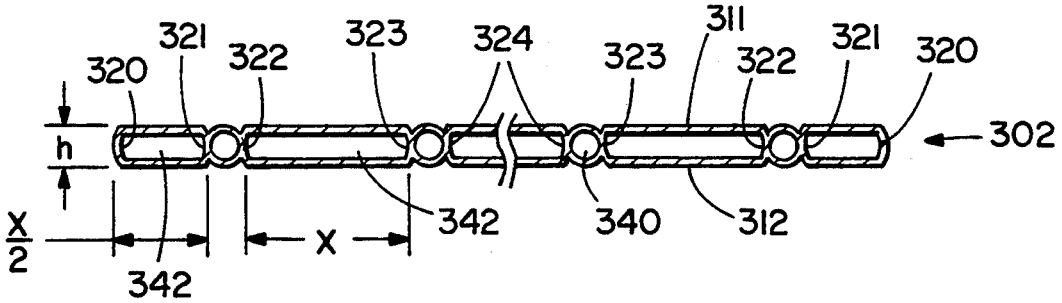
FIG. 30 is a cross-sectional view along line Y—Y of an embodiment of FIG. 28 showing a double layer extrudate of the present invention using round refrigerant conduits and rectangular air conduits.
Figure 31:
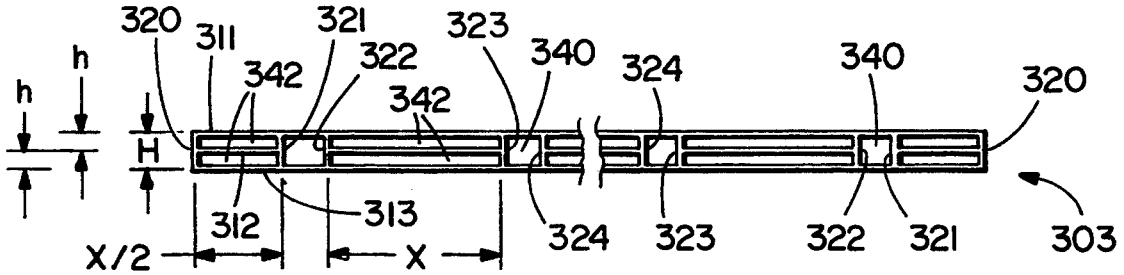
FIG. 31 is a cross-sectional view along line Y—Y of an embodiment of FIG. 28 showing a triple layer extrudate of the present invention.

The refrigerant conduits 340 and air conduits 342 of the multiply layer extrudate 300 may be extruded having various cross sectional widths, shapes, and sizes as illustrated in subsequent FIGS. 29–31 which are shown as cross-sectional views alone line Y—Y of FIG. 28.

FIG. 29 is a cross-sectional view alone line Y—Y of FIG. 28 showing a double layer extrudate 301 having generally square or rectangular cross-sectional shaped refrigerant conduits 340 and generally rectangular shaped air conduits 342 formed from a first layer 311 and second layer 312 of material spaced apart from one another in the vertical axis selected distances ("h"). The air conduits 342 are formed between refrigerant conduits 340 by a plurality of interior vertical refrigerant conduit sidewalls 321–324 disposed between exterior vertical air conduit sidewalls 320 and spaced apart from one another along the horizontal axis a selected distance ("X" and "X/2") joining the first layer 311 and second layer 312.

FIG. 30 is a cross-sectional view alone line Y—Y of FIG. 28 showing a double layer extrudate 302 having generally circular shaped refrigerant conduits 340 in combination with generally rectangular shaped air conduits 342 formed from a first layer 311 and second layer 312 spaced apart from one another in the vertical axis a selected distances ("h"). The air conduits 342 are formed between refrigerant conduits 340 by a plurality of interior vertical refrigerant conduit sidewalls 321–324 disposed between exterior vertical air conduit sidewalls 320 and spaced apart from one another along the horizontal axis a selected distance ("X" and "X/2") joining the first layer 311 and second layer 312.

FIG. 31 is a cross-sectional view alone line Y—Y of FIG. 28 showing a triple layer extrudate 303 having refrigerant conduits 340 formed having generally square or rectangular shaped cross-sectional areas in combination with generally rectangular shaped air conduits 342 formed from a first exterior layer 311, a second medial layer 312, and a third exterior layer 313, each layer being spaced apart in the vertical axis from the adjacent layer a selected distance ("h"). Moreover, the first exterior layer 311 is spaced apart from the third exterior layer 313 a total selected distance ("H"). A plurality of interior vertical refrigerant conduit sidewalls 321–324 are disposed between exterior vertical air conduit sidewalls 320 and spaced apart from one another along the horizontal axis a selected distance ("X" and "X/2"). The exterior air conduit sidewalls 320 and interior refrigerant conduit sidewalls 321–324 join the first layer 311, second layer 312, and third layer 313 forming separate air conduits 342 between refrigerant conduits 340.

Furthermore, as shown in FIGS. 29–31, the distance "X/2" between exterior air conduit sidewall 320 and interior refrigerant conduit sidewall 321 is one-half as great as the selected distance "X" between interior refrigerant conduit sidewalls 322 and 323.

Figure 32:
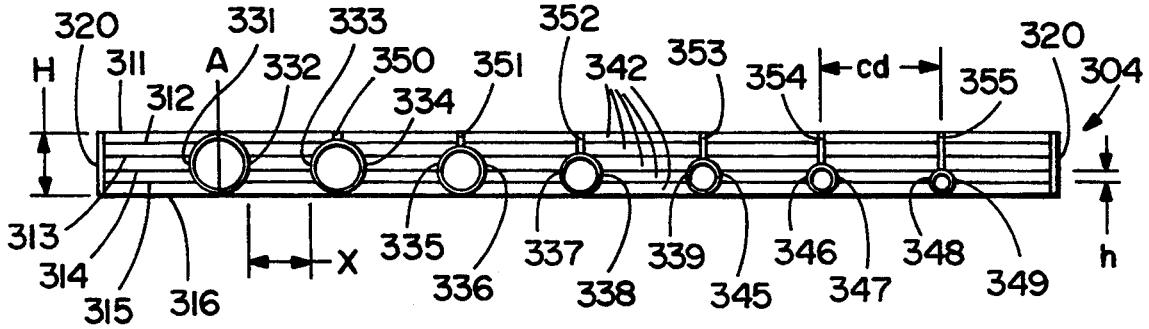
FIG. 32 is a cross-sectional view of a six layer tubular extrudate of the present invention.

FIG. 32 is a cross-sectional view of a six layer tubular extrudate 304 formed having a first layer 311, a second layer 312, a third layer 313, a fourth layer 314, a fifth layer 315, and a sixth layer 316, each layer being spaced apart from the adjacent layer a selected distances ("h") in the vertical axis. The six layer tubular extrudate 304 includes generally round, incrementally variable refrigerant conduits 343 integrally formed in combination with generally rectangular shaped air conduits 342. A plurality of semi-circular shaped interior refrigerant conduit sidewalls 331–339 and 345–349 having decreasing cross-sectional areas "A" are disposed between exterior vertical air conduit sidewalls 320 and spaced apart from one another along the horizontal axis a selected distance ("X" and "X/2") joining the first layer 311, second layer 312, third layer 313, fourth layer 314, fifth layer 315, and sixth layer 316. Moreover, the spacing ("X" and "X/2") of the layers 311–316 remains constant along the horizontal axis and the spacing of the incrementally variable refrigerant conduits 343 as measured from the center distance ("cd") of adjacent refrigerant conduits 343 varies according to the cross-sectional area of the incrementally variable refrigerant conduits 343. Vertical interior air conduit sidewalls 350–355 are formed positioned above and extending from the incrementally variable refrigerant conduits 343 having smaller cross-sectional dimensions ("A") outward to the first exterior layer 311.

Figure 33:
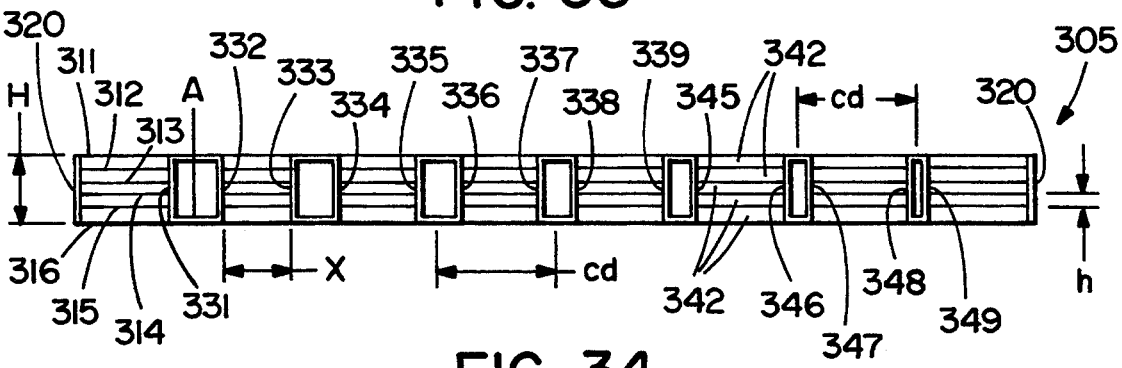
FIG. 33 is a cross-sectional view of a six layer rectangular extrudate.

With reference to FIG. 33, a six layer rectangular extrudate 305 is formed having a first layer 311, a second layer 312, a third layer 313, a fourth layer 314, a fifth layer 315, and a sixth layer 316, each layer being spaced apart from the adjacent layer a selected distances ("h") in the vertical axis. The six layer rectangular extrudate 305 includes generally rectangular incrementally variable refrigerant conduits 343 integrally formed in combination with generally rectangular shaped air conduits 342. A plurality of straight interior refrigerant conduit sidewalls 331–339 and 345–349 having decreasing cross-sectional areas "A" are disposed between exterior vertical air conduit sidewalls 320 and spaced apart from one another along the horizontal axis a selected distance ("X" and "X/2") joining the first layer 311, second layer 312, third layer 313, fourth layer 314, fifth layer 315, and sixth layer 316. The spacing ("X" and "X/2") of the layers 311–316 remains constant along the horizontal axis and the spacing of the incrementally variable refrigerant conduits 343 as measured from the center distance ("cd") of adjacent refrigerant conduits 343 varies according to the cross-sectional area of the incrementally variable refrigerant conduits 343. Because the distance ("X" and "X/2") of the air conduits 342 is constant so that the same amount of heat transfer surface is obtained using a shorter six layer rectangular extrudate 305 than with the six layer extrudate 303. Forming air conduits 342 of uniform width also facilitates the use of a uniform width lance to form strip fins 146 directly connected to the refrigerant conduit 343 within the air conduits 342.

The six layer rectangular extrudate 305 having generally square or rectangular shaped incrementally variable refrigerant conduits 343 provides an advantage as compared to the round shaped incrementally variable refrigerant conducts 343 in that all of the layers 311–316 are contiguous to the rectangular shaped incrementally variable refrigerant conduct 343 providing improved heat flow path or improved material economy. It is contemplated that spacing ("X" and "X/2") of air conducts 342 could be variable to provide fin lengths of optimal heat transfer efficiency wherein a variation in strip fin effectiveness as desired.

As with the quadruple sheet integral roll bonded refrigerant tube and strip fin heat exchanger circuit 100, the lancing process for forming strip fins 146 in the air conduits 342 of layers 311–316 is substantially the same.

Figure 34:
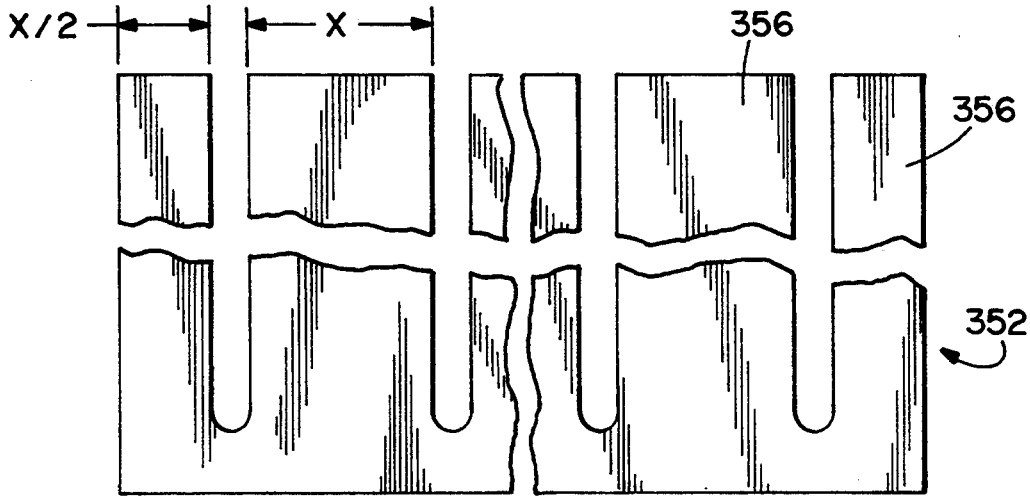
FIG. 34 is a top view of a primary die having longitudinal fingers of varying width.
Figure 35:
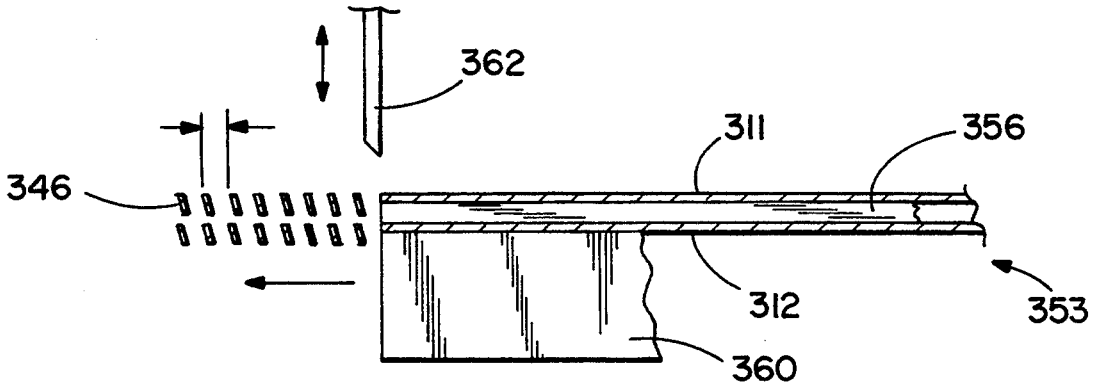
FIG. 35 is a side view showing a punch and die assembly having a primary die with a single set of fingers, wherein the air conduits of a double layer extrudate extend over the fingers of the primary die in preparation for lancing the air conduits and producing strip fins therein.
Figure 36:
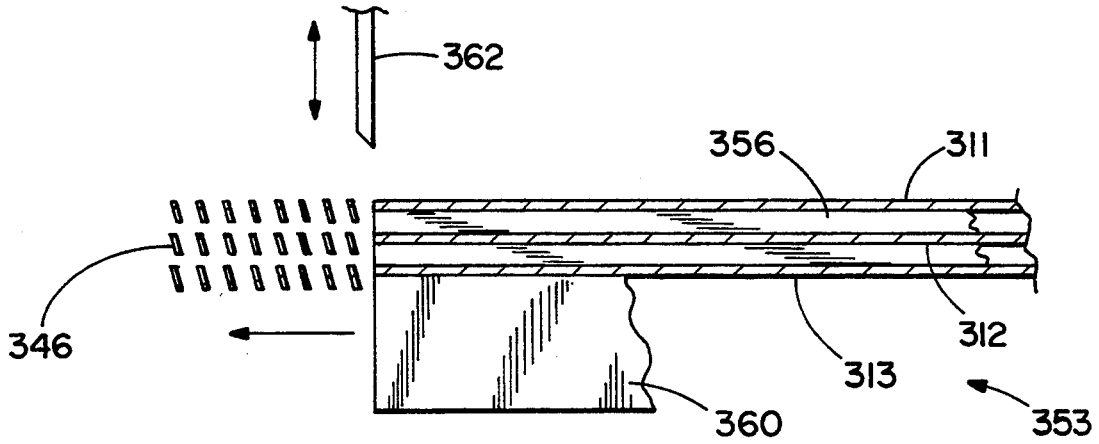
FIG. 36 is a side view showing a punch and die assembly having two primary die with stacked fingers, wherein the air conduits of a triple layer extrudate extend over the fingers of the primary die in preparation for lancing the air conduits and producing strip fins therein.
Figure 37:
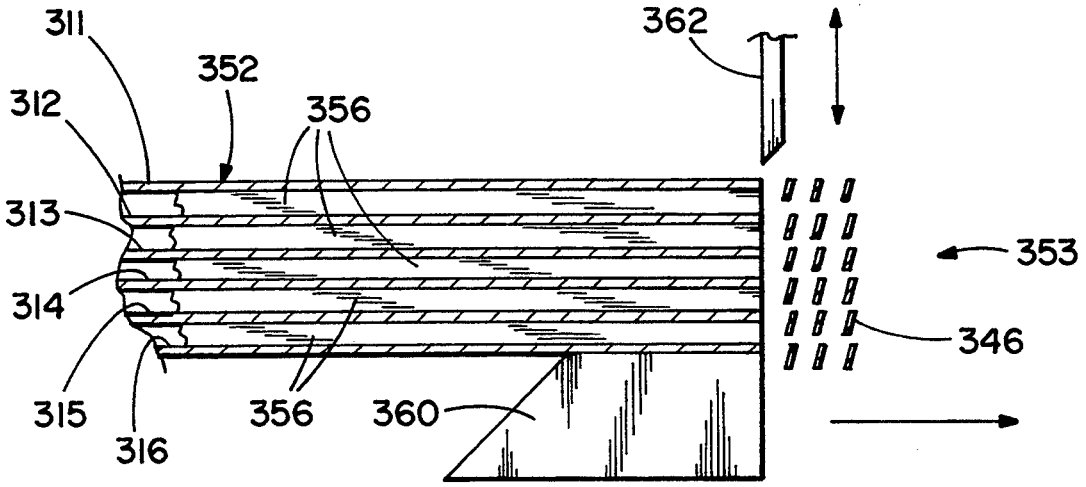
FIG. 37 is a side view showing a punch and die assembly having five primary dies with stacked fingers, wherein the air conduits of a six layer extrudate extend over the fingers of the primary die in preparation for lancing the air conduits and producing strip fins therein.

The lancing process to form the strip fins 146 in the air conduits 342 is generally the same for the extrudates as for the roll bonded heat exchanger circuits. The punch and die assembly 353 includes a primary die 352, as shown in FIG. 34, aligned in cooperative relationship with a secondary die 360 and a punch 362 as shown in FIGS. 35–37. The primary die 352 includes the desired number of horizontally spaced and vertically stacked longitudinal members or fingers 356 aligned in a cooperative relationship with the secondary die 360 and punch 362.

The fingers 356 of the primary die 352 shown in FIG. 34 are horizontally spaced according to the width ("X" and "X/2") of extrudates 301, 302, and 303 as shown in FIGS. 29–31. The air conduits 342 are inserted over the fingers 356 of the primary die 352 as shown in FIGS. 35–37. The side view of FIG. 35 shows that the layers 311 and 312 of the double layer extrudates 301 and 302 extend over a double layer of fingers 356 of primary die 352. The triple layer extrudate 303 shown in FIG. 31 requires two primary dies 352 having an additional layer of vertically stacked primary die fingers 356 as shown in FIG. 36, wherein the first layer 311, second layer 312, and third layer 313 extend over a double layer of primary die fingers 356. The six layer extrudates 304 and 305 shown in FIGS. 32 and 33, respectively, require five layers of vertically stacked primary die fingers 356 having fingers 356 spaced apart along the horizontal axis to correspond to the variable width ("X" and "X/2") of the air conduits 342. As shown in FIG. 37, first layer 311, second layer 312, third layer 313, fourth layer 314, fifth layer 315, and sixth layer 316 extend over a five layers of fingers 356 of primary die 352.

Punching multiple layers of strip fins 146 per stroke requires approximately the same amount of time as for punching two layers of strip fins 46. Feed and strip fin pitch relationships are also the same as described for the roll bonded embodiment. Unlike the roll bonded embodiments formed in a serpentine pattern having return bends integrally formed therein, the extrudates 301–305 have straight air conduits 342 permitting lancing of all of the air conduits 342 in a single pass through the punch and die assembly 353.

Figure 38:
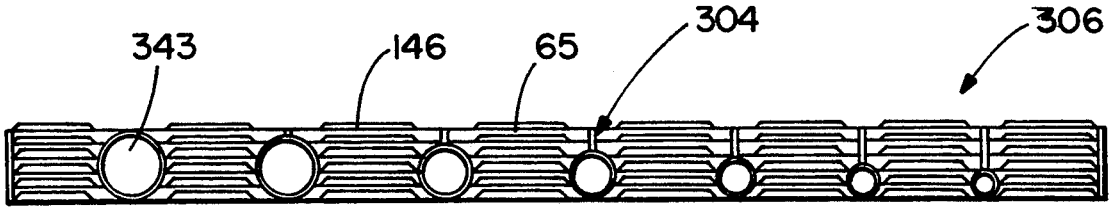
FIG. 38 is cross-sectional view of an integral extruded tubular refrigerant tube and strip fin heat exchanger circuit formed from lancing the extrudate of FIG. 32.
Figure 39:
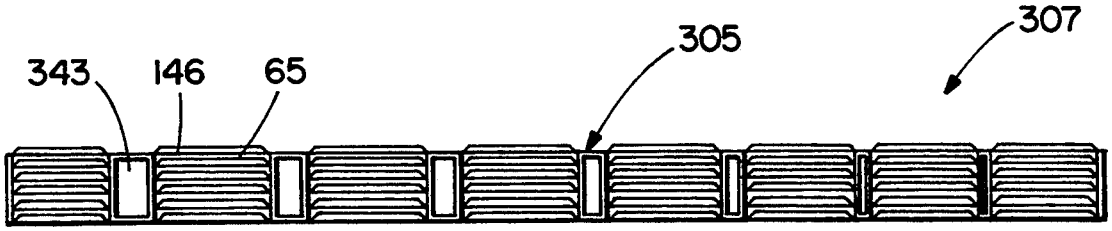
FIG. 39 is cross-sectional view of an integral extruded rectangular refrigerant tube and strip fin heat exchanger circuit formed from lancing the extrudate of FIG. 33.

FIGS. 38 and 39 are cross-sectional views of integral extruded tubular refrigerant tube and strip fin heat exchanger circuits 306 and integral extruded rectangular refrigerant tube and strip fin heat exchanger circuits 307 formed from lancing extrudates 304 and 305, respectively. Moreover, FIGS. 38 and 39 show the strip fins 146 formed between the incrementally variable refrigerant conduits 343 by lancing layers 311–316 of the six layer extrudates 304 and 305. FIGS. 38 and 39 show the advantage of using incrementally variable refrigerant conduits 343 having square or rectangular cross-sectional dimensions in incrementally variable multiply layer extrudates 300 to maximize the width of the air conduits 342 for optimal heat transfer with respect to the incrementally variable refrigerant conduits 343.

Figure 40:
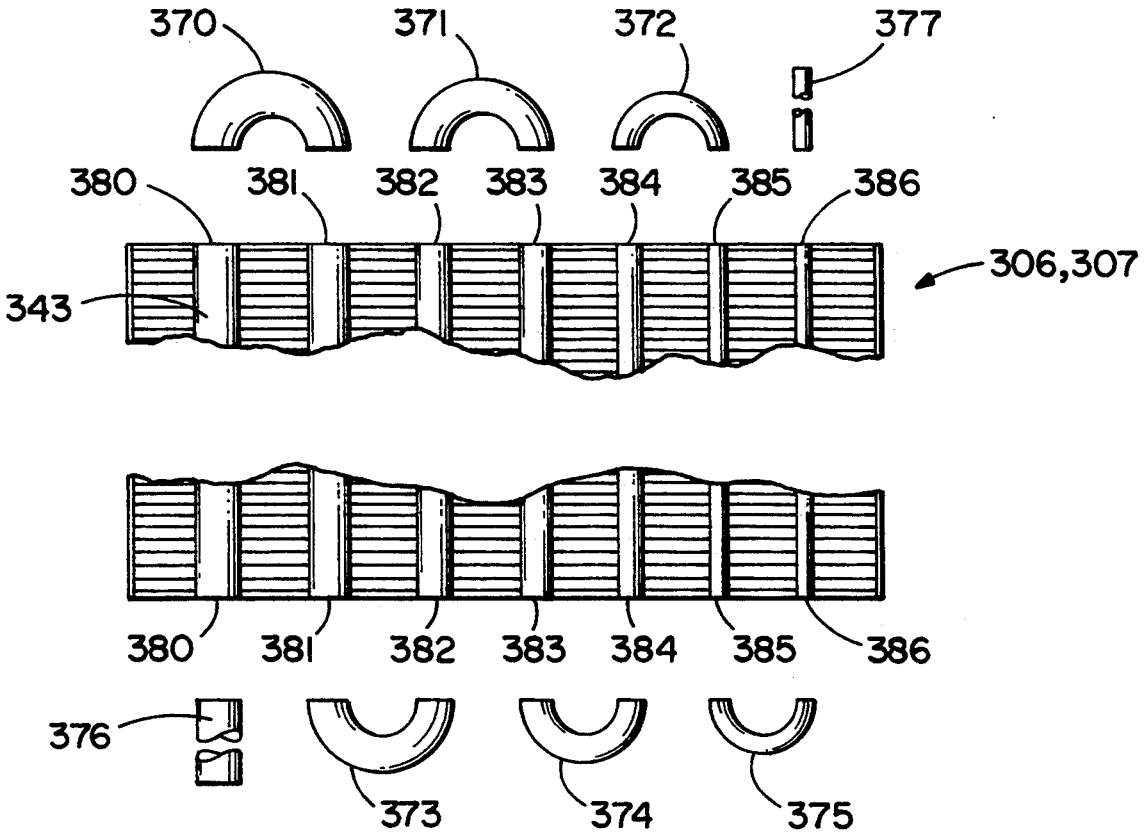
FIG. 40 is a top view of an extruded integral tubular refrigerant tube and strip fin heat exchanger circuit or extruded integral rectangular refrigerant tube and strip fin heat exchanger circuit of the present invention after completion of the lancing process, showing connection tubes and a plurality of tapered return bends correspondingly sized to cooperate with the ends of the incremetally variable refrigerant conduits.

As shown in FIG. 40, after completion of the lancing process, a first connection tube 376, a second connection tube 377, and a plurality of return bends 370–375 are correspondingly sized to cooperate with the distal ends 380–386 of the incrementally variable refrigerant conduits 343 of the extruded integral tubular refrigerant tube and strip fin heat exchanger circuit 306 and extruded integral rectangular refrigerant tube and strip fin heat exchanger circuit 307 shown in FIGS. 38 and 39.

As best shown in FIG. 40, the complete extruded integral tubular refrigerant tube and strip fin heat exchanger circuit 308 and extruded integral rectangular refrigerant tube and strip fin heat exchanger circuit 309 are formed by joining the incrementally variable refrigerant conduits 343 of extrudates 306 and 307 with cooperating return bends 370–375, sized and tapered according to the size of the distal ends 380–386 of the incrementally variable refrigerant conduits 343. For simplicity, only seven refrigerant conduits 343 are shown; however, it is contemplated that circuits having additional incrementally variable refrigerant conduits 343 could be utilized to minimize the size variation by many discrete increments.

Figure 41:
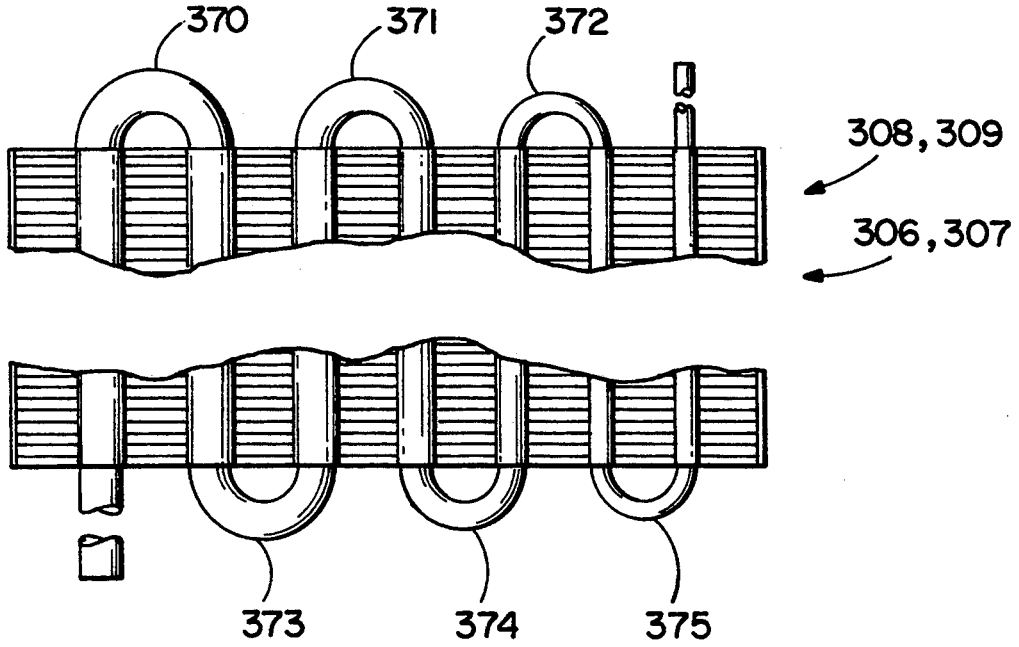
FIG. 41 is a top view of a complete extruded integral refrigerant tube and strip fin heat exchanger circuit formed from joining the tapered return bends to the incrementally variable refrigerant conduits.

Joining of the return bends 370–375 and connection tubes 376 and 377 is accomplished by one of many joining processes such as ultrasonic dip brazing or adhesives to form a complete extruded integral tubular refrigerant tube and strip fin heat exchanger circuit 308 and extruded integral rectangular refrigerant tube and strip fin heat exchanger circuit 309 as shown in FIG. 41.

The foregoing detailed description is given primarily for clearness of understanding and no unnecessary limitations are to be understood therefrom for modification will become obvious to those skilled in the art upon reading this disclosure and may be made upon departing from the spirit of the invention and scope of the appended claims.

I claim:

1. A roll bonded integral tube and strip fin heat exchanger circuit comprising:

a first thermally conductive sheet of material roll bonded at preselected points to a second sheet of thermally conductive material bonding said first sheet and said second sheet together at said preselected points defining a generally serpentine pattern forming an integral roll bonded laminate, said integral roll bonded laminate being expanded with a fluid such as gas integrally forming a refrigerant conduit and at least one air circuit adjacent thereto; and said air conduit being lanced forming at least two fin strips having a plurality of strip fins with slits thereinbetween, whereby air circulates through said air conduit and said slits, and around said fins and said refrigerant conduit to increase heat transfer between said air and said refrigerant conduit.

2. The roll bonded integral tube and strip fin heat exchanger circuit of claim 1, including a third sheet and a fourth sheet of thermally conductive material roll bonded together with said first and said second sheet at preselected points defining a generally serpentine pattern and forming an integral quadruple sheet roll bonded laminate, said integral roll bonded laminate being expanded forming a refrigerant conduit and at least two air conduits; and said air conduits being formed integrally with and adjacent to at least one side of said refrigerant conduit, said air conduits being lanced forming four fin strips having a plurality of strip fins with slits thereinbetween.

3. The roll bonded integral tube and strip fin circuit of claim 2, wherein said thermally conductive sheet of material has a wall thickness in the range of from about 0.030 to about 0.035 inches in thickness before roll bonding.

4. The roll bonded integral tube and strip fin circuit of claim 2, wherein said thermally conductive sheet of material has a wall thickness in the range of from about 0.10 to about 0.020 inches in thickness after roll bonding.

5. The roll bonded integral tube and strip fin circuit of claim 2, wherein the roll bonding process forms a finished product having a total refrigerant conduit wall thickness in the range of 0.020 to 0.030 of an inch in order to contain from 300 to 700 pounds of refrigerant per square inch.

6. The roll bonded integral tube and strip fin heat exchanger circuit of claim 1, wherein the cross-sectional area of said refrigerant conduits is constant.

7. The roll bonded integral tube and strip fin heat exchanger circuit of claim 1, including a means to control the velocity of the refrigerant and reduce pressure drop in the refrigerant conduit.

8. The roll bonded integral tube and strip fin heat exchanger circuit of claim 7, wherein said means to control the velocity of the refrigerant and reduce pressure drop in the refrigerant conduit is by varying the cross-sectional area of the conduits by tapering and/or expanding the refrigerant conduits.

9. The roll bonded integral tube and strip fin circuit of claim 1, wherein said strip fins are oriented generally perpendicular to the direction of air flow.

10. The roll bonded integral tube and strip fin circuit of claim 1, wherein the continuity of the ends of said strip fins are maintained with the fin strip for improved handling.

11. The roll bonded integral tube and strip fin circuit of claim 1, wherein said thermally conductive sheet of material is selected from the group consisting of aluminum, copper, brass, tin, nickel and alloys thereof.

12. The roll bonded integral tube and strip fin circuit of claim 1, wherein said thermally conductive sheet of material has a wall thickness in the range of from about 0.060 to about 0.065 inches in thickness before roll bonding.

13. The roll bonded integral tube and strip fin circuit of claim 1, wherein said thermally conductive sheet of material has a wall thickness in the range of from about 0.20 to about 0.035 inches in thickness after roll bonding.

14. The roll bonded integral tube and strip fin circuit of claim 1, wherein said thermally conductive sheet of material contains a range of from about 300 to about 700 pounds of pressure of refrigerant per square inch.

15. The roll bonded integral tube and strip fin heat exchanger circuit of claim 1, wherein each fin strip contains from about six to about thirty-six strip fins per inch forming strip fins having a width of from about 1/6th to about 1/36 of an inch in each fin strip.

16. The roll bonded integral tube and strip fin heat exchanger circuit of claim 1, wherein said strip fins are twisted at an angle ranging from about zero to about thirty degrees from the vertical axis normal to the surface of the fin strip.

17. The roll bonded integral tube and strip fin heat exchanger circuit of claim 1, wherein the length of said strip fin is selected to provide a fin effectiveness of about 85 percent.

18. A punch blade for lancing strip fins in roll bonded or extruded integral tube and strip fin heat exchanger of claim 1, comprising:

a front planar surface;

a rear planar surface;

a pair of side edges connecting said front and rear planar surfaces;

an end edge connecting said front and rear planar surfaces and said pair of side edges;

said end edge and said side edges forming a rounded tip having a radius being equal to the width of a selected air conduit;

said end edge and said side edges being beveled from the front backward from about a twenty-five to about a thirty-five degree angle; and said punch blade having a length of at least one expanded refrigerant conduit thickness greater than the number of expanded refrigerant conduits in a roll bonded laminate or an extruded layers forming the integral tube and strip fin circuit heat exchanger.

19. An extruded integral tube and strip fin heat exchanger circuit comprising an extrudate having at least one refrigerant conduit and at least one air conduit sharing at least one common interior sidewall, said air conduit being lanced forming at least two fin strips having a plurality of strip fins with slits thereinbetween, whereby air circulates through said air conduit and said slits, and around said fins and said refrigerant conduit to increase heat transfer between said air and said refrigerant conduit.

20. The extruded integral tube and strip fin heat exchanger circuit recited in claim 19, wherein said extrudate comprises a plurality of refrigerant conduits and a plurality of air conduit comprising spaced apart layers separated by a plurality of spaced apart sidewalls disposed between said layers.

21. The extruded integral tube and strip fin heat exchanger circuit recited in claim 20, wherein the distal ends of at least two refrigerant conduits are joined together by a return bend.

22. The extruded integral tube and strip fin heat exchanger circuit recited in claim 20, wherein said refrigerant conduits comprise incrementally variable sized conduits.

23. The extruded integral tube and strip fin heat exchanger circuit recited in claim 21, wherein said return bends are tapered according to the size of said refrigerant conduits.

24. The extruded integral tube and strip fin heat exchanger circuit recited in claim 19, wherein said refrigerant conduit has a generally circular cross-sectional shape.

25. An extruded integral tube and strip fin heat exchanger circuit comprising an extrudate having at least one refrigerant conduit having a generally rectangular cross-sectional shape and at least one air conduit sharing at least one common interior sidewall, said air conduit being lanced forming at least two fin strips having a plurality of strip fins with slits thereinbetween, whereby air circulates through said air conduit and said slits, and around said fins and said refrigerant conduit to increase heat transfer between said air and said refrigerant conduit.

* * * * *